US006979769B1

(12) United States Patent
Majima et al.

(10) Patent No.: US 6,979,769 B1
(45) Date of Patent: Dec. 27, 2005

(54) DATA REPRODUCING DEVICE, DATA REPRODUCING METHOD, AND INFORMATION TERMINAL

(75) Inventors: Yoshiyuki Majima, Shizuoka-ken (JP); Shinobu Katayama, Hamamatsu (JP); Hideaki Minami, Tokyo (JP)

(73) Assignee: Faith, Inc., Kyoto (JP)

( * ) Notice: Subject to any disclaimer, the term of this patent is extended or adjusted under 35 U.S.C. 154(b) by 0 days.

(21) Appl. No.: 09/936,055

(22) PCT Filed: Feb. 3, 2000

(86) PCT No.: PCT/JP00/00602

§ 371 (c)(1),
(2), (4) Date: Sep. 7, 2001

(87) PCT Pub. No.: WO00/54249

PCT Pub. Date: Sep. 14, 2000

(30) Foreign Application Priority Data

Mar. 8, 1999 (JP) ..... 11/060919

(51) Int. Cl.[7] ..... G10A 7/00
(52) U.S. Cl. ..... 84/645; 434/307 A
(58) Field of Search ..... 84/645; 434/307 A

(56) References Cited

U.S. PATENT DOCUMENTS

| | | | | |
|---|---|---|---|---|
| 5,953,005 | A * | 9/1999 | Liu | 715/500.1 |
| 6,281,424 | B1 * | 8/2001 | Koike et al. | 84/636 |
| 6,283,764 | B2 * | 9/2001 | Kajiyama et al. | 434/307 A |
| 6,424,944 | B1 * | 7/2002 | Hikawa | 704/260 |
| 6,429,366 | B1 * | 8/2002 | Terada | 84/645 |
| 6,782,299 | B1 * | 8/2004 | Tsuji et al. | 700/94 |

FOREIGN PATENT DOCUMENTS

| | | |
|---|---|---|
| EP | 715296 | 5/1996 |
| EP | A2715296 | 5/1996 |
| JP | 044473 | 1/1992 |
| JP | 05-110536 | 4/1993 |
| JP | A5110536 | 4/1993 |
| JP | A5143070 | 6/1993 |
| JP | 06-318090 | 11/1994 |
| JP | 318090 | 11/1994 |
| JP | A6318090 | 11/1994 |

(Continued)

OTHER PUBLICATIONS

MIDI Bible II, MIDI 1.0 Practice, pp. 071, 134-135, (1998).

*Primary Examiner*—Jeffrey W Donels
(74) *Attorney, Agent, or Firm*—Birch, Stewart, Kolasch & Birch, LLP.

(57) ABSTRACT

Each of MIDI data, audio data, text data and image data to be received in a data receiving section is SMF-formatted data including event information and event-executing delta time. A data sorting section sorts data based on data type depending upon a delta time of each type of received data. The sorted data are respectively reproduced in a MIDI reproducing section, an audio reproducing section, a text reproducing section and an image reproducing section. The data reproduced in the MIDI reproducing section and audio reproducing section are mixed in a mixer and outputted as sound from a speaker, while the data reproduced in the text reproducing section and image reproducing section are mixed in a mixer and displayed as visual information on a display. Because each type of data is reproduced in the timing according to the delta time, synchronization can be easily provided between different types of data, for example as sound and images.

19 Claims, 28 Drawing Sheets

FOREIGN PATENT DOCUMENTS

| | | |
|---|---|---|
| JP | 07-028462 | 1/1995 |
| JP | A728462 | 1/1995 |
| JP | 07-327222 | 12/1995 |
| JP | A7327222 | 12/1995 |
| JP | 08-054888 | 2/1996 |
| JP | A854888 | 2/1996 |
| JP | 08-087271 | 4/1996 |
| JP | A887271 | 4/1996 |
| JP | 08-160959 | 6/1996 |
| JP | 160959 | 6/1996 |
| JP | A8160959 | 6/1996 |
| JP | A9134173 | 5/1997 |
| JP | 09-214371 | 8/1997 |
| JP | A9214371 | 8/1997 |
| JP | 10-020877 | 1/1998 |
| JP | 020877 | 1/1998 |
| JP | A1020877 | 1/1998 |
| JP | A10150505 | 2/1998 |
| JP | 10-105186 | 4/1998 |
| JP | A10105186 | 4/1998 |
| JP | A10124071 | 5/1998 |
| JP | A10173737 | 6/1998 |
| JP | 10-187174 | 7/1998 |
| JP | 187174 | 7/1998 |
| JP | A10187174 | 7/1998 |
| JP | A10198361 | 7/1998 |
| JP | A10312189 | 11/1998 |

* cited by examiner

| | |
|---|---|
| X 1 | X 2 STARTING ADDRESS |
| X 2 | X 3 STARTING ADDRESS |
| Y 1 | Y 2 STARTING ADDRESS |
| X 3 | X 4 STARTING ADDRESS |
| Y 2 | Y 3 STARTING ADDRESS |
| X 4 | X 5 STARTING ADDRESS |
| ⋮ | ⋮ |

DATA REPRODUCING DEVICE, DATA REPRODUCING METHOD, AND INFORMATION TERMINAL

This application is the national phase under 35 U.S.C. §371 of PCT International Application No. PCT/JP00/00602 which has an International filing date of Feb. 3, 2000, which designated the United States of America.

TECHNICAL FIELD

The present invention relates to a data reproducing apparatus, data reproducing method and information terminal used in reproducing the data that is different in attribute, such as sound and images.

BACKGROUND OF THE INVENTION

Due to the development of multimedia, various types of information are supplied through a network. These types of information include, representatively, sound, text or images. In karaoke communications, for example, music titles and words are text information, accompaniment melodies and background choruses are sound information, and background motion pictures are image information.

In karaoke communications, these various kinds of information are simultaneously distributed through the network so that each type of information is reproduced on the terminal unit. By providing synchronization mutually between these different types of information, the color of the words is varied or the motion picture is varied as the music progresses.

Conventionally, in order to provide synchronization, clocks have been provided in the respective programs for processing each of the different types of information, i.e., sound, text and images, whereby the synchronizing process has been made according to the time information of clocks. Using this configuration, wherein the system load is increased or so, there is possible mutual disagreement between the clocks, thereby causing so-called synchronizing deviation and hence deviated timing of the output of each type of information occurs. Thus, this results in disagreement between sound and images.

Meanwhile, sound, text, image data or the like is read out by accessing, every time, a file according to a command thus requiring time in processing. Furthermore, because the files have been separately prepared on a data-type basis, there also has been a problem with file management.

SUMMARY OF THE INVENTION

Therefore, it is a feature of the present invention to provide a data reproducing apparatus and data reproducing method capable of easily providing synchronization of reproducing various kinds of information that have different attributes.

Another feature of the invention is to provide a data reproducing apparatus with easy file management without the necessity of preparing files based on data type.

Another feature of the invention is to provide a data reproducing apparatus capable of easily embedding arbitrary information, such as sound, text and images, in an existing data format.

Another feature of the invention is to provide a data reproducing apparatus adapted for karaoke communications.

Another feature of the invention is to provide a data reproducing apparatus capable of obtaining realistic music play.

Another feature of the invention is to provide a data reproducing method capable of reducing the transfer amount of data where data is repetitively reproduced.

Another feature of the invention is to provide a satisfactory data reproducing method having a small capacity of a communication line.

Another feature of the invention is to provide a data reproducing method capable of further reducing the amount of reproduced data.

Another feature of the invention is to provide a data reproducing method capable of suppressing noise occurrence during data reproducing.

Another feature of the invention is to provide a data reproducing apparatus and data reproducing method capable of processing data at high speed.

Another feature of the invention is to provide a data reproducing apparatus capable of stably reproducing data regardless of capacity variation on the transmission line.

Another feature of the invention is to provide an information terminal capable of downloading various kinds of information different in attribute, such as sound, text and images, and reproducing these for output as sound or visual information.

Another feature of the invention is to provide an information terminal capable of carrying out a proper process for interrupt signals in the information terminal having a function of a phone or game machine.

Another feature of the invention is to provide an information terminal capable of downloading and making use of music, words and a jacket picture data on CD (Compact Disk) or MD (Mini Disk).

Another feature of the invention is to provide an information terminal capable of making use of each downloaded data by storing the data on a small-sized information storage medium.

Another feature of the invention is to provide a data reproducing apparatus that, when receiving the data to view commercial information, the service by the commercial provider is available.

In the present invention, MIDI is an abbreviation of Musical Instrument Digital Interface, that is an International Standard for mutual communications with signals of music play between the electronic musical instruments or between the electronic musical instrument and the computer. Meanwhile, SMF is an abbreviation of Standard MIDI File, that is a standard file format comprising time information called delta time and event information representative of music play content or the like. It should be noted that the terms "MIDI" and "SMF" in the present Specification are used as noted in the above meanings.

In the invention, the data to be received includes event information and time information representing when an event is to be executed, and comprises data in a format of SMF or the like. The received data is sorted by data type depending upon respective time information so that an event of sorted data may be executed to reproduce the data.

In the invention, because the time information and the information of sound, text, images and the like are integral, the time information can be utilized as synchronizing information by reproducing various kinds of data according to the time information possessed by them. As a result, it is possible to easily provide synchronization between different kinds of data as in sound and images. Also, there is no need to separately prepare and manage files based on data type, thus facilitating file management. Furthermore, there is no necessity to access various kinds of files every time, thereby increasing the speed of processing.

The reception data can be configured with first data having MIDI event information and second data having event information of other than MIDI. The second data can be considered, for example, the data concerning text, images, audio or the like.

The MIDI event is a gathering of the commands for controlling tone generation of the musical instruments. For example, instruction command forms are taken as "Start Tone Generation" "Stop Tone Generation ". Also, the MIDI event is to be added with a delta time as time information and turned into an SMF-formatted data so that such an event as "Tone Generation Start" or "Tone Generation Stop" is executed when a predetermined time comes according to a time represented by the delta time.

On the other hand, events other than MIDI include a META event or a system exclusive event. These events can be in extended format as hereinafter referred so that various kinds of data can be embedded in the extended format. The use of such an SMF extended format can easily record various kinds of data, such as sound and images without major modification to the format.

The present invention receives the data having each of event information of MIDI, text and images to output reproduced MIDI data as sound and reproduced text and image data as visual information, thereby making possible to realize a data reproducing apparatus suited for karaoke. In this case, the addition of voice besides MIDI as audio makes it possible to reproduce a musical-instrument playing part in MIDI and a vocal part such as background chorus in voice, thus realizing realistic music play.

In the case of repetitively reproducing the second data having event information other than MIDI, it is preferred to previously store first-received data to a memory so that, when data is repetitively reproduced, only the time information of the second data concerning reproducing is transmitted. By doing so, the amount of data transferred can be decreased.

Also, in the case of reproducing the second data following the first data, it is preferred to divide the reproduced data in the second data into a plurality of data, to transmit a data group having the plurality of divisional data inserted between the preceding ones of first data, to extract the inserted divisional data from the data group at the reception side, and to combine the extracted divisional data into reproduced data. This smoothen the amount of transmission data and satisfactorily makes the communication line with small capacity. In this case, the extracted divisional data is sequentially stored to the memory in a chronological fashion and the area in which divisional data is stored is recorded by a start address of the following divisional data to which the relevant divisional data is coupled, thereby easily, positively combining together the divisional ones of data.

Furthermore, by cutting away the silence sections of the reproduced data to be recorded to the second data, the data amount can be further reduced. In this case, it is preferred to carry out a fade-in/out process to a signal in the vicinity of a rise portion and fall portion of the reproduced data to suppress noise.

In another embodiment of a data reproducing apparatus of the invention, each of data different in attribute is sorted, for each unit section, and stored in a storage section depending upon the time information thereof, sequentially being read out of the storage section and reproduced in the next unit section. Because the process of received data is made in a pipeline form, processing is possible at higher speed. Also, time synchronization can be easily provided by managing time information data and unit-section time width to forward only the data to be processed in the relevant unit section to the storage section.

The data reproducing apparatus according to the invention can adopt a stream scheme that data is reproduced while being downloaded. In this case, if the amount of data being consumed by reproducing exceeds the amount of data being taken, there arises data insufficiency and discontinuity in sound, images or the like. Accordingly, by caching a required amount of data to thereafter start reproducing, data can be continuously reproduced without encountering discontinuity.

The data reproducing apparatus according to principles consistent with the invention can be mounted on an information terminal such as cellular phone or game machine, wherein various kinds of data can be downloaded from a server by making use of a terminal communicating function. By providing a speaker for outputting sound or display for displaying text and images to the information terminal, music or images can be heard or viewed on the terminal. In the case of a phone, it is preferred to output an incoming tone by prohibiting sound from being outputted from the speaker upon receiving an incoming signal. In the case of a game machine, a sound effect due to MIDI can also be outputted together with sound from the speaker.

A small-sized information storage medium can be removably provided on the data reproducing apparatus according to the invention, whereby various kinds of downloaded data can be stored, for reutilization, in the information storage medium. For example, if downloading music data in MIDI or audio, music words or commentary data in text and jacket picture data in images respectively, the information storage medium itself can be utilized as CD or MD.

In the invention, by previously including an Internet URL and the information concerning service to be offered in the URL in commercial-information text data to be received and then causing jump to a homepage of the URL following the reproducing of commercial, various services can be offered to the commercial viewers.

DETAILED DESCRIPTION

Figure 1:
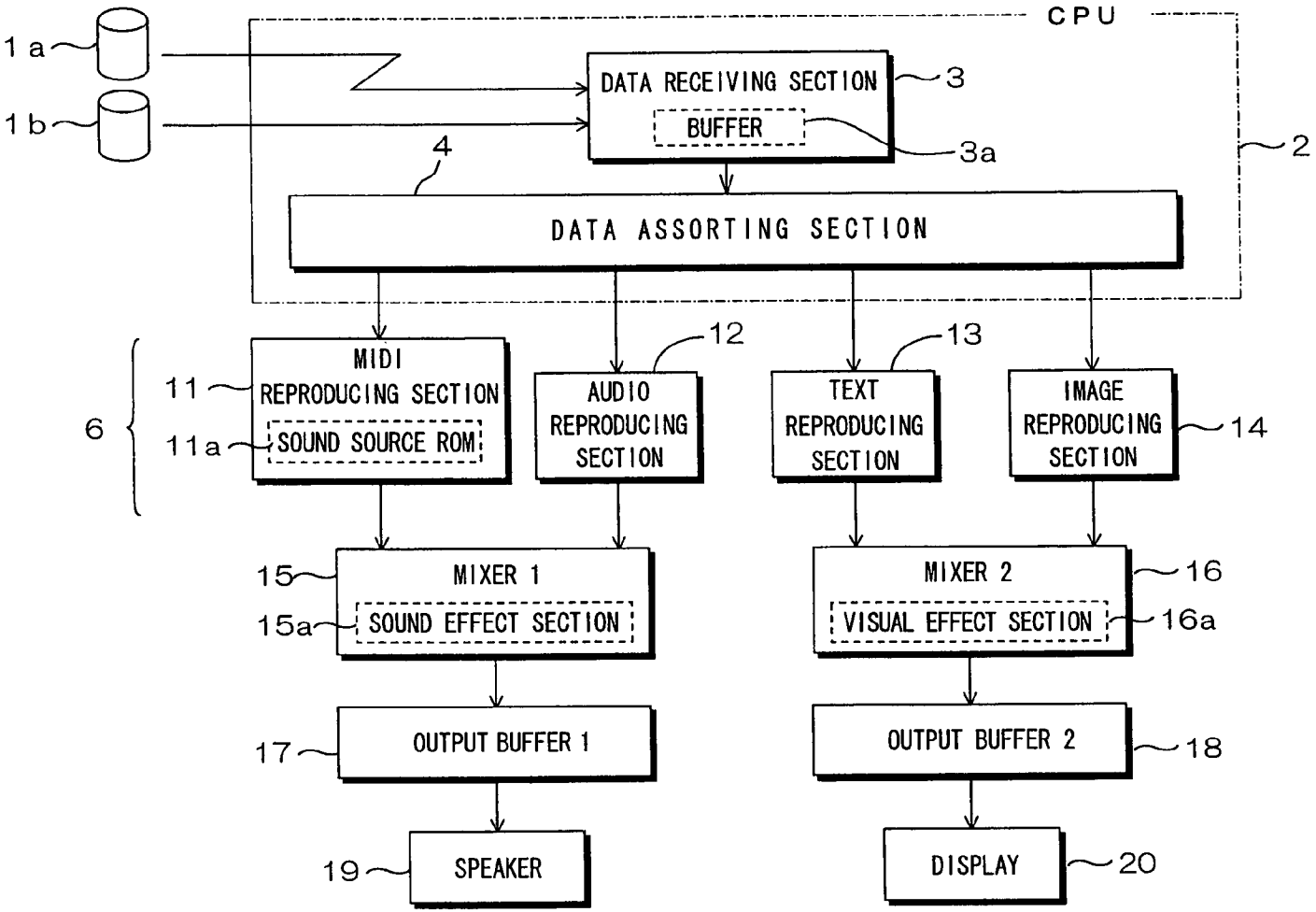
FIG. 1 is a block diagram showing an example of a data reproducing apparatus of the present invention.

An example of a data reproducing apparatus is shown in FIG. 1. In FIGS. 1, 1*a*, 1*b* is a file on which data is recorded, wherein 1*a* is for example a file existing in a server on the Internet, and 1*b* is for example a file on a hard disk within the apparatus.

2 is a CPU for controlling the data reproducing apparatus overall, and structured including a data receiving section 3 and a data sorting section 4. Although the CPU 2 includes additional blocks having various functions, those in the present invention are not in direct relation and thus are omitted. The data receiving section 3 has access to the file 1*a*, 1*b* to receive the data stored therein. The data in the file 1*a* is received, through a wire or wirelessly. The received data is temporarily stored in a buffer 3*a*. The data section 4 sorts the data received by the data receiving section 3, into a data reproducing section 6 based on data type.

The data reproducing section 6 is configured with a MIDI reproducing section 11 to reproduce the MIDI data, an audio reproducing section 12 to reproduce the audio data, a text reproducing section 13 to reproduce text data and an image reproducing section 14 to reproduce the image data. The MIDI reproducing section 11 has a sound-source ROM 11*a* storing the sound-source data of various musical instruments used for the music to be reproduced. This sound-source ROM 11*a* can be replaced with a RAM and mounted with the built-in data replaced. The image reproducing section 14 has a function to reproduce still images and motion images.

15 is a mixer for mixing the outputs of the MIDI reproducing section 11 and audio reproducing section 12, and 16 is a mixer for mixing the outputs of the text reproducing section 13 and image reproducing section 14. The mixer 15 is provided with a sound effect section 15*a* to process for echo addition or the like, while the mixer 16 is provided with a visual effects section 16*a* to process a special effect addition to an image. 17 is an output buffer for temporarily storing the output of the mixer 15, and 18 is an output buffer for temporarily storing the output of the mixer 16. 19 is a speaker as a sound generating section for outputting sound depending on the data of the output buffer 17, and 20 is a display for displaying visual information of characters, illustrations or the like on the basis of the data of the output buffer 18.

Figure 2:
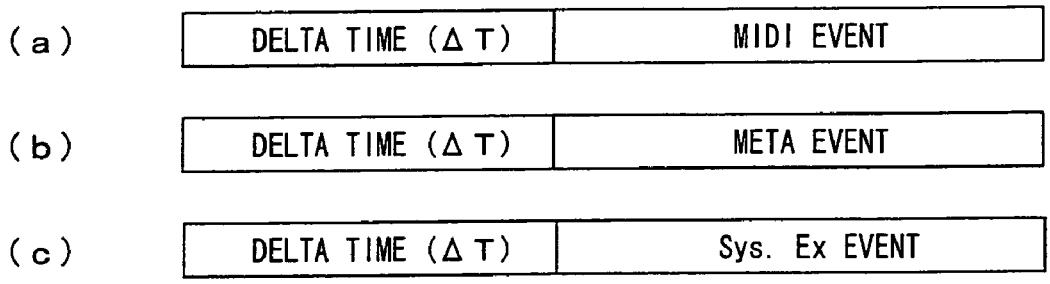
FIG. 2 is a figure showing a format of SMF-formatted reception data.

SMF-formatted data recorded in the files 1*a*, 1*b* is inputted to the data receiving section 3. The SMF-formatted data generally comprises time information, called delta time, and event information representative of a music-play content or the like, and includes three types shown in FIGS. 2(*a*)–(*c*) in accordance with a kind of event information. 2(*a*) is the data having the event information comprising a MIDI event, 2(*b*) is the data having the event information comprising a META event and 2(*c*) is the data having event information comprising a Sys. Ex event.

Figure 3:
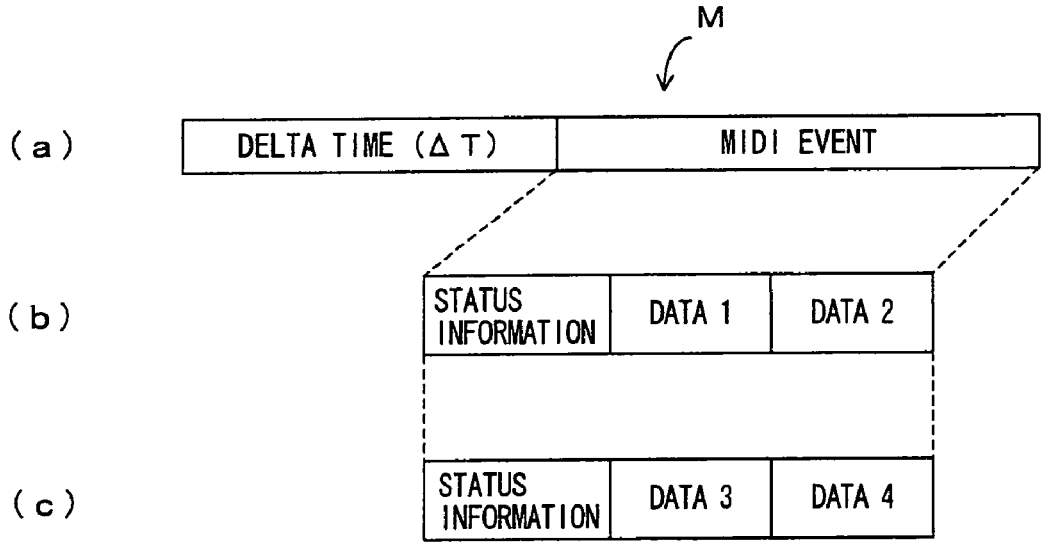
FIG. 3 is a format example of the data concerning MIDI.

The detail of the MIDI event is shown in FIG. 3. FIG. 3(*a*) is the same as FIG. 2(*a*). The MIDI event comprises status information and data, as shown in FIGS. 3(*b*) and 3(*c*). FIG. 3(*b*) is an event of a tone-generation start command wherein the status information is recorded with a musical instrument, data 1 is with a scale and data 2 is with a tone intensity, respectively. Meanwhile, FIG. 3(*c*) is an event of a tone-generation stop command, wherein the status information is recorded with a musical instrument, data 3 is with a scale and data 4 is with a tone intensity, respectively. In this manner, the MIDI event is an event storing music-play information wherein one event configures a command, e.g. "Generate Tone With Piano Sound At this Intensity".

Figure 4:
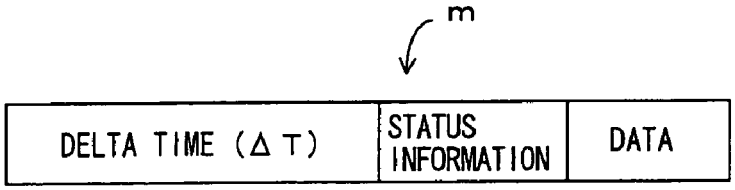
FIG. 4 is a format example of the data concerning simplified-formed MIDI.

FIG. 4 shows an example of a simplified MIDI format reduced in data amount by simplifying the format of FIG. 3. FIG. 3 separately configures the tone start command and the tone stop command, whereas FIG. 4 integrates tone generation and stop into one by adding a tone-generating time in the data. Meanwhile, tone intensity data is omitted and scale data is included in the status information. Although the format of FIG. 4 is not a standard format like an SMF, the data to be dealt with in the invention includes the other formats than the one like an SMF.

Figure 5:
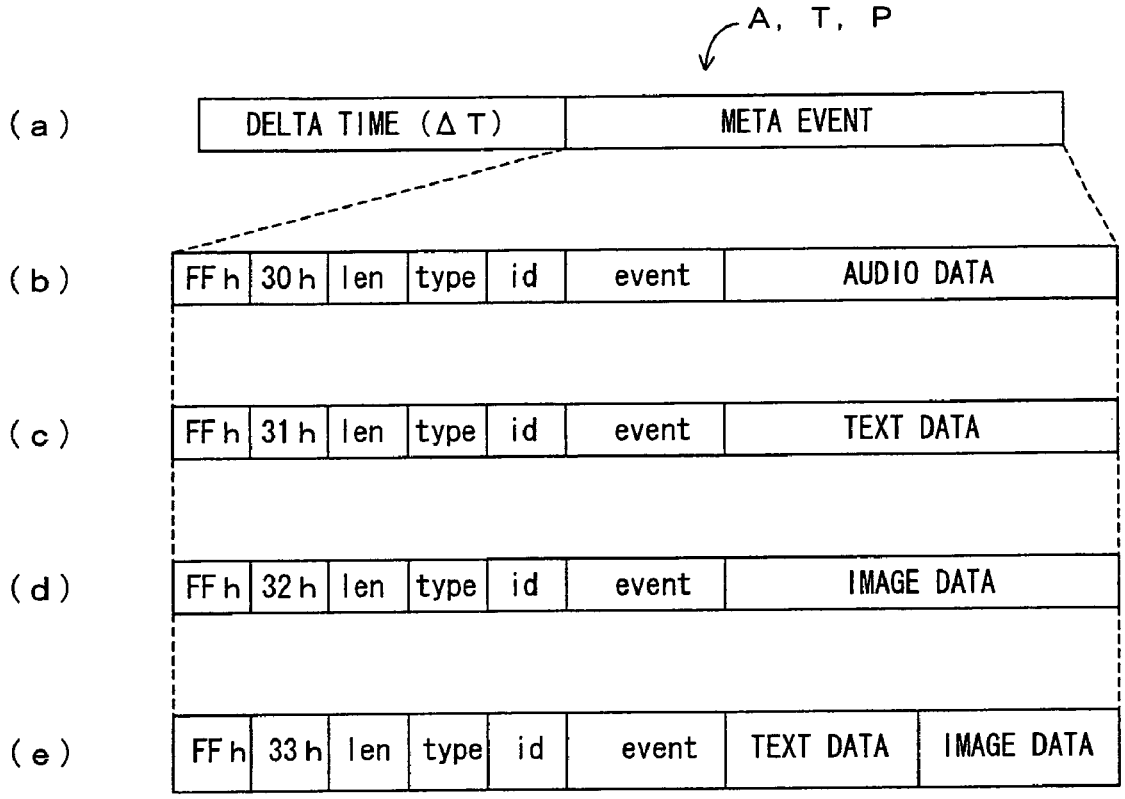
FIG. 5 is a format example of the data concerning audio, text and images.

The detail of the META event is shown in FIG. 5. FIG. 5(*a*) is the same as FIG. 2(*b*). The META event, an event for transferring data or controlling reproduce start/stop, is allowed to extend the format so that a variety of data can be embedded within the extended format. FIGS. 5(*b*)–(*e*) show format examples of extended META events. 5(*b*) is a format with embedded audio data, 5(*c*) a format with embedded text data, 5(*d*) a format with embedded image data and 5(*e*) a format with embedded text data and image data, respectively. The image includes a moving image, besides a still image such as illustration and picture.

The FFh at the top is a header showing that this event is a META event. The next 30*h*, 31*h*, . . . , 33*h* are identifiers representing that the format of the META event is an extended format. Meanwhile, len represents a data length of the META event, type represents a format of data to transfer, and id represents a data number. Event is to show an event content to be executed, and is represented by a command, e.g. "Start Audio Data Transfer" or "End Image Data Transfer". The end point of such data can be known from a len value representative of a data length.

Figure 6:
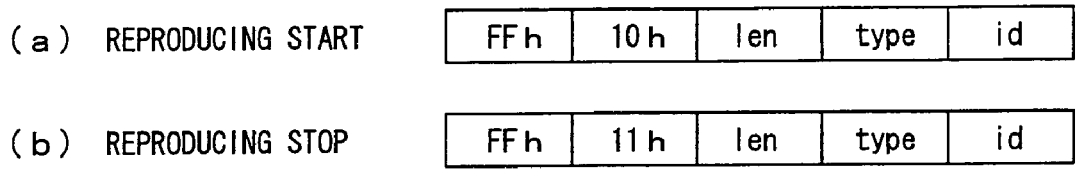
FIG. 6 is a format example of a META event concerning control.

The META event includes a format concerning control besides the extended format recording the data as above. FIG. 6 is one example of the same, wherein 6(*a*) shows an event format for reproduce start and 6(*b*) for reproduce stop. 10*h* in 6(*a*) and 11*h* in 6(*b*) are, respectively, commands for reproduce start and reproduce stop. The other FFh, len, type and id are the same as FIG. 5, hence explanations are omitted.

Figure 7:
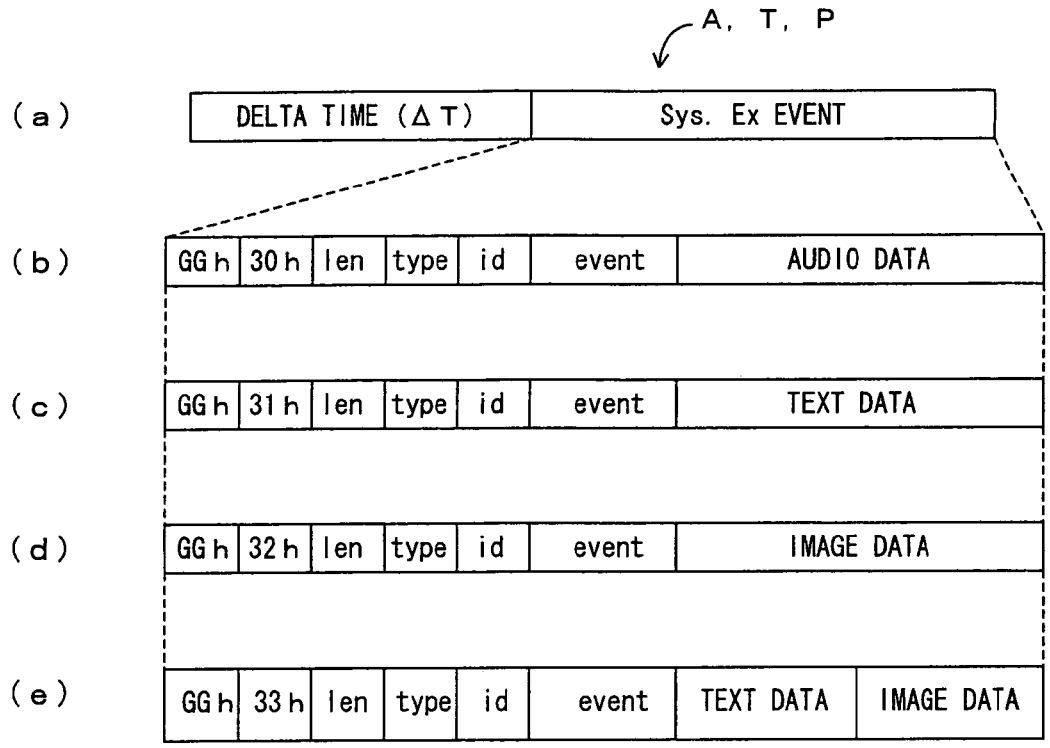
FIG. 7 is another format example of the data concerning audio, text and images.

The detail of the Sys. Ex event is shown in FIG. 7. FIG. 7(*a*) is the same as FIG. 2(*c*). The Sys. Ex event is called an exclusive event, e.g. an event concerning the set information for setting in a system adapted for an orchestra and the like. This Sys. Ex event is also possible to extend so that various kinds of data can be embedded in the extended format. FIGS. 7(*b*)–(*e*) show a format example of an extended Sys. Ex event, which is in a format similar to FIG. 5.

Figure 8:
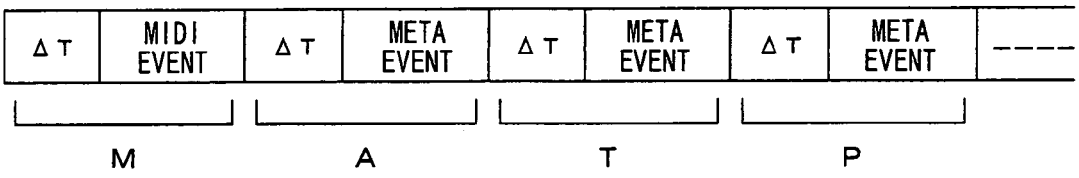
FIG. 8 is a format example of a data row.

The SMF-formatted data is configured as above, where data are combined in numbers to constitute a series of data. FIG. 8 shows an example of such a data row. M is data concerning MIDI and has a format shown in FIG. 3. A is data concerning audio and has a format shown in FIG. 5(*b*). T is data concerning text and has a format shown in FIG. 5(*c*). P is data concerning an image and has a format shown in FIG. 5(*d*). The order of arrangement of each of data is not limited to FIG. 8 but there can exist a variety of patterns. Also, although in FIG. 8 the data of audio, text and images are described in a META event, these can be recorded in the Sys. Ex event. Each of data M, A, T, P is configured as a packet, which are chained into a series comprising a data row. The data row is to be received by a data receiving section 3 of FIG. 1 and stored in the buffer 3*a*.

The received data is sorted in the data sorting section on the basis of a delta time ΔT thereof, to execute an event in the data reproducing section 6 and reproduce the data. The timing of an event to be executed is determined by the delta time ΔT. Namely, an event is executed when the relationship between a lapse time ΔT from the immediately preceding event executed and a delta time ΔT of an event to be currently executed is in $\Delta t \geqq \Delta T$. In other words, if a certain event is executed, the lapse time from a start of the event is counted. When the lapse time is equal to a delta time of the next event or exceeds it (there is a case not exactly coincident with but exceeding a delta time because the time resolving power by the CPU is finite), the next event is executed. In this manner, the delta time is information representing the time it takes to execute the current event depending on what amount of time elapses from the immediately preceding event. Although the delta time does not represent an absolute time, the time from a start of reproducing can be calculated by integrating the delta time.

Hereunder, explanation is made on the detail of reproducing in each section of the data reproducing section 6. First, explained below is the operation of reproducing in the MIDI reproducing section 11. In FIG. 1, the data sorting section 4 of the CPU 2 sequentially reads the received data out of the buffer 3*a* according to a program stored in a not-shown ROM. If the read-out data is data M concerning MIDI (FIG. 3), its event information is supplied to the MIDI reproducing section 11. If the event content is, for example, a command "Generate Tone Mi With Piano Sound", the MIDI reproducing section 11 decrypts this command to read a piano sound from the sound-source ROM 11*a* and creates a synthesizer sound by a software synthesizer thereby starting to generate a tone at a scale of mi. From then on, the CPU 2 counts a lapse time. If this lapse time is equal to the delta time attached to the next event "Stop Tone Generation of Mi" or exceeds it, this command is supplied to the MIDI reproducing section 11 so that the MIDI reproducing section 11 decrypts the command to cease the tone generation of mi. In this manner, the tone of mi is reproduced with a piano sound only in the duration of from a tone generation start to a tone generation stop.

Next, the CPU 2 counts a lapse time from a tone generation stop of mi. If this lapse time is equal to, for example, a delta time attached to the next event "Generate Tone Ra With Piano Sound" or exceeds it, this command is supplied to the MIDI reproducing section 11. The MIDI reproducing section 11 decrypts this command to read a piano sound from the sound-source ROM 11*a* and create a synthesizer sound thereby starting tone generation at a scale of ra. From then on the CPU 2 counts a lapse time. If the lapse time is equal to a delta time attached to the next event "Stop Tone Generation of Ra" or exceeds it, this command is supplied to the MIDI reproducing section 11. The MIDI reproducing section 11 decrypts this command to stop the tone generation of ra. In this manner, the tone of ra is reproduced with a piano sound only in the duration of from the tone generation start to the tone generation stop. By the repetition of such an operation, the MIDI reproducing section 11 reproduces a sound according to MIDI.

Next, explanation is made on reproducing of the data having other event information than MIDI. As in the foregoing, each of an audio data, text data and image data is recorded in a META event (FIG. 5) or Sys. Ex event (FIG. 7). In FIG. 1, the data sorting section 4 sequentially reads the received data from the buffer 3*a*, similarly to the above. In the case that the read-out data is data A concerning audio, the event information of the read-out data is sorted to the audio reproducing section 12 according to a delta time. The audio reproducing section 12 decrypts the content of the relevant event and executes the event, thus reproducing an audio. Where the read-out data is data T concerning a text, the event information of the read-out data is sorted to the text reproducing section 13 according to a delta time. The text reproducing section 13 decrypts the content of the relevant event and executes the event, thus reproducing a text. Where the read-out data is data P concerning an image, the event information of the read-out data is sorted to the image reproducing section 14 according to a delta time. The image reproducing section 14 decrypts the content of the relevant event and executes the event, thus reproducing an image.

More specifically, if the audio reproducing section 12 receives, for example, an event "Generate Sound B" from the data sorting section 4, the audio reproducing section 12 decodes and reproduces the data of a sound B added to the relevant event. From then on, the CPU 2 counts a lapse time. If the lapse time is equal to, for example, a delta time attached to the next event "Display Character C" or exceeds it, the text reproducing section 13 decodes and reproduces the data of a character C added to the relevant event. Next, the CPU 2 counts a lapse time from the reproduction of the character C. If the lapse time is equal to, for example, a delta time attached to the next event "Display Illustration D" or exceeds it, the image reproducing section 14 decodes and reproduces the data of an illustration D added to the relevant event. This, in this respect, is basically similar to the principle of the reproducing of MIDI data.

The above explanation was made for purpose of convenience, separately between the reproduce operation by the MIDI reproducing section 11 and the reproduce operation by the other reproducing section 12–14 than MIDI. However, actually as shown also in FIG. 8 the data receiving section 3 is chronologically, mixedly inputted by data M having a MIDI event and data A, T, P having an event other than MIDI. For example, different kinds of data is sequentially inputted, e.g. MIDI (M)→illustration (P)→text (T)→MIDI (M)→audio (A)→motion image (P)→ . . . . The data sorting section 4 sorts these types of data to each reproducing section 11–14 based on data type according to a delta time. Each reproducing section 11–14 carries out a reproducing process of data corresponding thereto.

The data reproduced in the MIDI reproducing section 11 and the data reproduced in the audio reproducing section 12 are mixed together by a mixer 15 and echo-processed by the sound effect section 15*a*, and thereafter temporarily stored in the output buffer 17 and outputted as a sound from the speaker 19. On the other hand, the data reproduced in the text reproducing section 13 and the data reproduced in the image reproducing section 14 are mixed together by a mixer 16 and subjected to a special effect image or the like in the visual effect section 15*a*, and thereafter temporarily stored in the output buffer 18 and displayed as visual information on the display 20. Then, when the data sorting section 4 receives a META event for reproduce stop shown in FIG. 6(*b*), the reproducing of data is ended.

In this manner, in the data reproducing apparatus of FIG. 1, each of data can be reproduced through sorting based on data type from a data row mixed with MIDI, audio, text and images. Upon reproducing a text or image, a delta time is referred to similarly to MIDI reproducing so that data is reproduced in the timing dependent upon the delta time. Consequently, by merely describing a delta time, synchronization can be easily made between different kinds of data, such as sound and images. Meanwhile, because there is no need to build clocks in a program for processing each of data as required in the conventional system, no problems occur with synchronization deviation due to the mismatch between the clocks.

Figure 9:
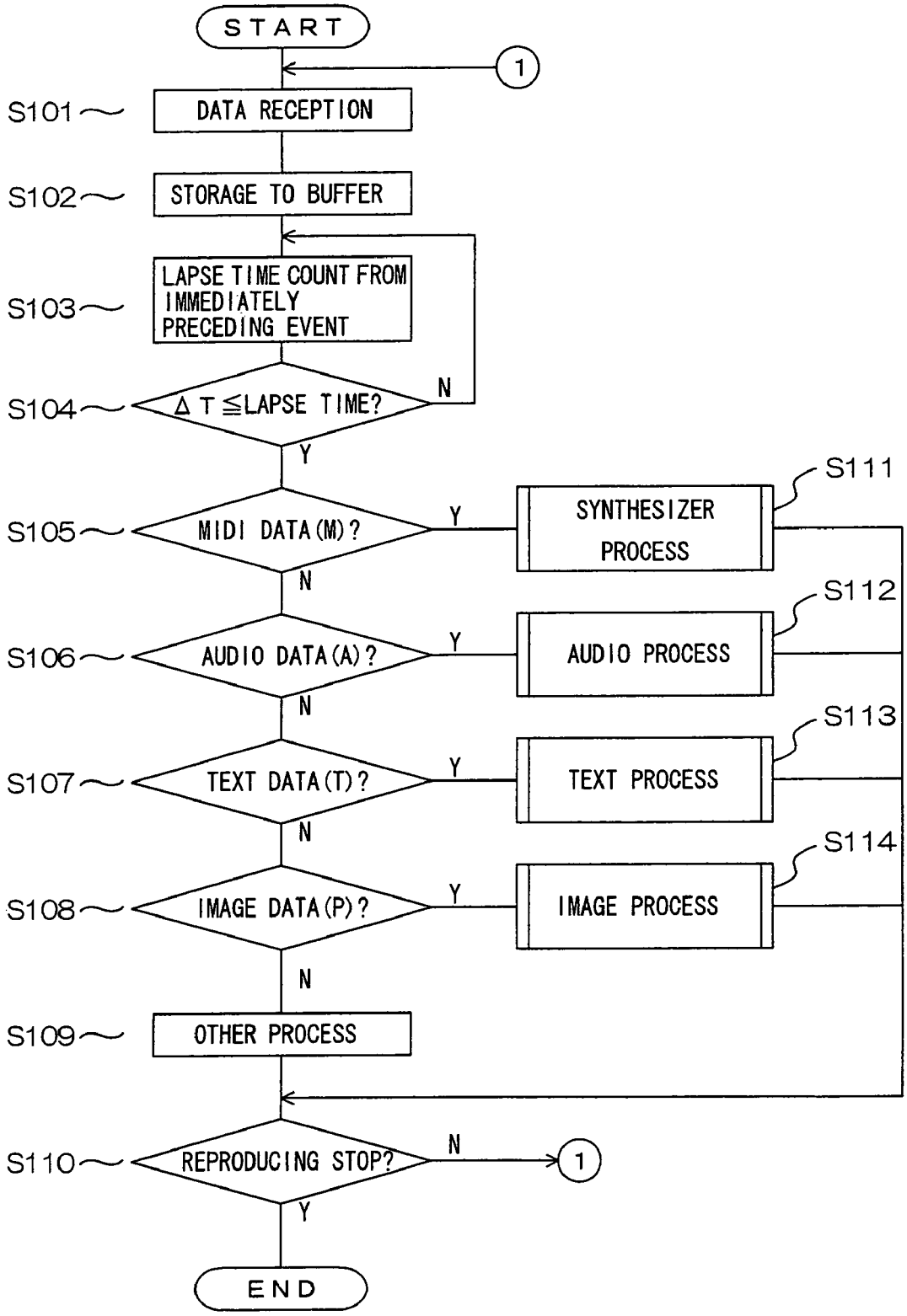
FIG. 9 is a flowchart showing an example of a data reproducing method according to the invention.

FIG. 9 is a flowchart showing a data reproducing method in the reproducing apparatus of FIG. 1, showing a procedure to be executed by the CPU 2. Hereunder, explanation is made on the operation with exemplification that the reproducing apparatus is a reproducing apparatus for communications karaoke. The step of flowchart will be abbreviated "S".

If the data receiving section 3 receives data from a file 1*a* of a server on a network through a communication line (S101), this received data is stored to the buffer 3*a* (S102). Next, the data sorting section 4 reads out the data from the buffer 3*a* and counts a lapse time from an execution of the immediately preceding event (S103). Then, a determination is made as to whether this lapse time coincides with a time represented by a delta time (or exceeds it) (S104). If the delta time is not exceeded (S104 NO), S103 is returned to continue counting the lapse time. If the lapse time coincides with or exceeds the delta time (S104 YES), processing proceeds to S105.

In processing the data, the type of the received data is first determined. Namely, it is determined whether the received data is MIDI data M or not (S105). If it is a MIDI data (S105 YES), this is sorted to the MIDI reproducing section 11 so that a synthesizer sound is created in the MIDI reproducing section 11 (S111). The detailed principle of the same was already described, hence the explanation being omitted herein. Due to sound reproducing by the synthesizer, a karaoke accompanying melody is outputted from the speaker 19.

If the received data is not MIDI data M (S105 NO), then whether the data is audio data A or not is determined (S106). If it is audio data A (S106 YES), this is sorted to the audio reproducing section 12 so that a audio process is carried out in the audio reproducing section 12 thereby reproducing an audio (S112). The detailed principle of the same was already described, the explanation being omitted herein. In reproducing the audio data, a vocal such as a background chorus is outputted from the speaker 19.

If the received data is not audio data A (S106 NO), then whether the data is text data T or not is determined (S107). If text data T (S107 YES), this is sorted to the text reproducing section 13 so that a text process is carried out in the text reproducing section 13 thereby reproducing text (S113). In reproducing the text data, the title or words of karaoke music is displayed on the display 20.

If the received data is not text data T (S107 NO), then whether the data is image data P or not is determined (S108). If the data is image data P (S108 YES), this is sorted to the image reproducing section 14 so that a process for a still image or motion image is carried out in the image reproducing section 14 thereby reproducing an image (S114). In reproducing the image data, a background image such as an animation or motion image is displayed on the display 20.

If the received data is not image data (S108 NO), the same data is for example data concerning setting or control and a predetermined process in accordance with its content is carried out (S109). Subsequently, it is determined whether to stop the reproducing or not, i.e. whether received a META event of FIG. 6(*b*) or not (S110). In the case where the reproducing is not stopped (S110 NO), processing returns to S101 to wait for receiving the next data. If it is determined to stop the reproducing (S110 YES), the operation is ended.

As in the foregoing, the data reproducing apparatus of FIG. 1 is made as an apparatus adapted for karaoke communications by the provision of the sound reproducing section comprising the MIDI reproducing section 11 and the audio reproducing section 12 and the visual information reproducing section comprising the text reproducing section 13 and the image reproducing section 14. In the invention, the audio reproducing section 12 is not necessarily required but can be omitted. However, by providing the audio reproducing section 12 to reproduce a musical instrument part in the MIDI reproducing section 11 and reproduce a vocal part in the audio reproducing section 12, the vocal part can be reproduced with an inherent sound thus realizing realistic music play.

The SMF-formatted data to be received by the data receiving section 3 is stored in the file 1*a* of the server on the network as described before. New data is periodically uploaded to the file 1*a*, to update the content of the file 1*a*.

Figure 10:
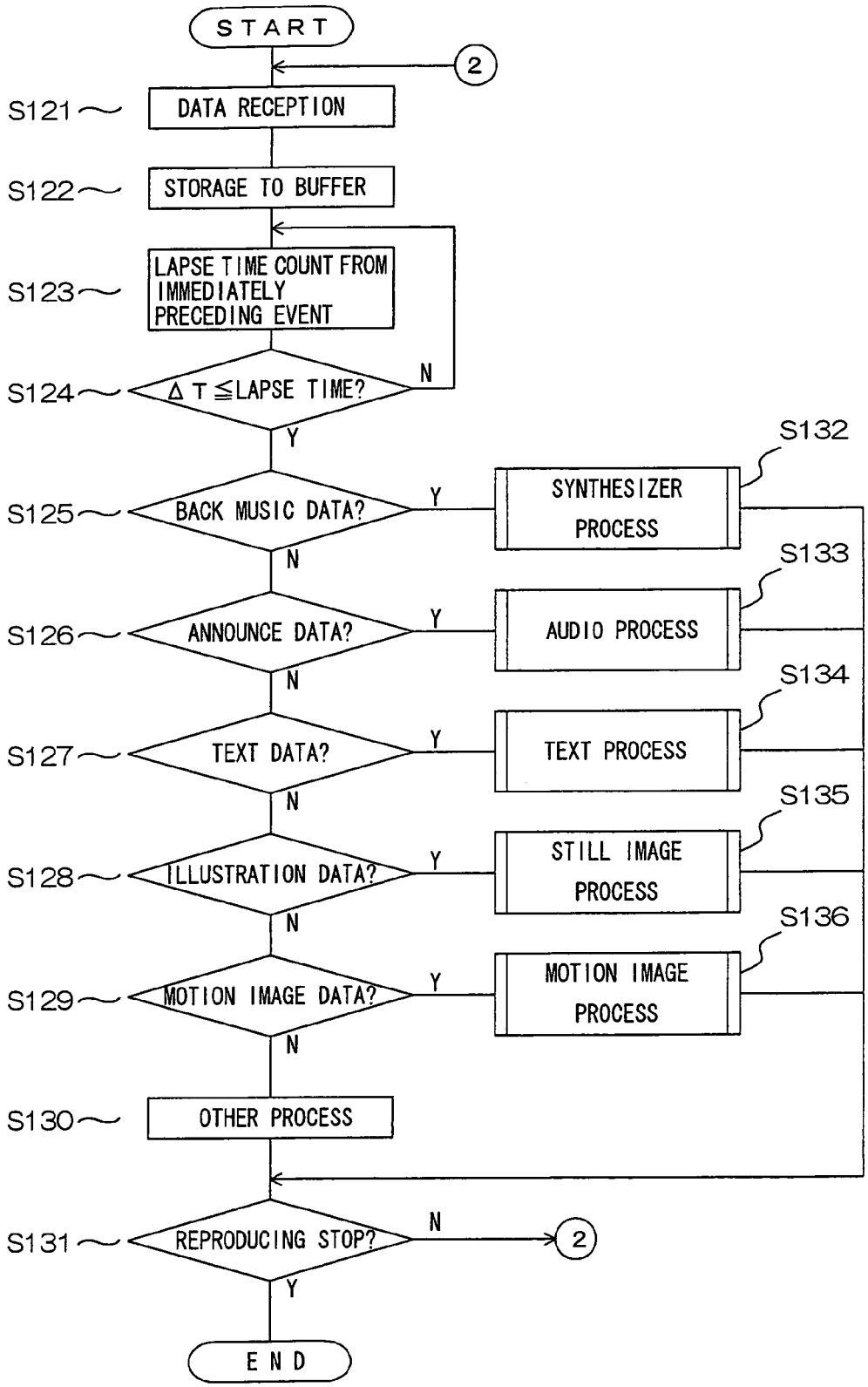
FIG. 10 is a flowchart showing another example of a data reproducing method according to the invention.

FIG. 10 is a flowchart showing a reproducing method in the case where the data reproducing apparatus of FIG. 1 is used in the broadcast of television CM (commercial), showing a procedure to be executed by the CPU 2. In the figure, S121–S124 correspond, respectively, to S101–104 of FIG. 9, wherein the operations thereof are similar to the case of FIG. 9 and hence explanation is omitted.

If a predetermined time is reached to enter a process (S124 YES), it is determined whether the received data is data of music to be played in a background of CM or not (S125). Here, the data for a background music is configured by MIDI. If the data is background music data (S125 YES), it is sorted to the MIDI reproducing section 11 to carry out a synthesizer process, thereby reproducing a sound (S132). This outputs a CM background music from the speaker 19.

If the received data is not background music data (S125 NO), it is then determined whether it is data for an announcement that an announcer is to say or not (S126). The announcement data is configured by audio data. If it is announcement data (S126 YES), it is sorted to the audio reproducing section 12 to carry out an audio process thereby reproducing an audio (S133). By reproducing the audio, an announcer commentary or the like is outputted from the speaker 19.

If the received data is not announcement data (S126 NO), it is then determined whether the data is text data representative of a product name or the like or not (S127). If the data is text data (S127 YES), this is sorted to the text reproducing section 13 so that a text is reproduced in the text reproducing section 13 and displayed on the display 20 (S134).

If the received data is not text data (S127 NO), it is then determined whether the data is illustration data or not (S128). If the data is illustration data (S128 YES), this is sorted to the illustration reproducing section 14 so that a still image process is carried out in the image reproducing section 14 thereby reproducing an illustration and displaying it on the display 20 (S135).

If the received data is not illustration data (S128 NO), it is then determined whether the data is motion image data or not (S129). If the data is motion image data (S129 YES), this is sorted to the image reproducing section 14 so that a motion image process is carried out in the image reproducing section 14 thereby reproducing a motion image and displaying it on the display 20 (S136).

If the received data is not motion image data (S129 NO), advancement is to S130. S130 and S131 correspond, respectively, to S109 and S110 of FIG. 9 and the operations thereof are similar to FIG. 9, hence explanation is omitted.

In the foregoing reproducing method, in reproducing audio, text and image data embedded in the SMF-formatted data, there are cases of reproducing the same data with repetition a certain number of times. For example, there are cases that karaoke background chorus is repeated thrice or the same text are displayed twice in the start and end portions of CM. In such cases, there is a problem of an increase in data amount if the data in the number corresponding to the number of times of repetition is embedded in the format of FIG. 5 or FIG. 7.

Figure 11:
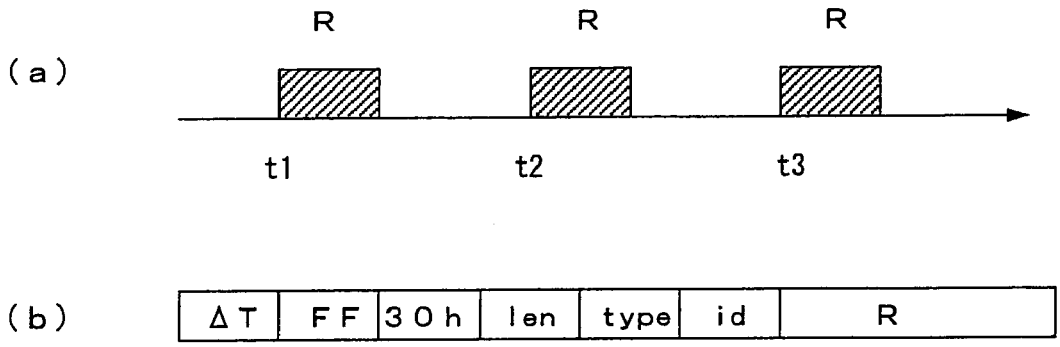
FIG. 11 is a figure explaining a repetitive reproducing process of data.

Accordingly, the method shown in FIG. 11 is to be considered as a solution. Namely, where reproducing the same data R with thrice repetition in the timing of t1, t2 and t3 as in (a), the transmitting side (server) firstly forwards once a packet embedded with the data R as in (b). The receiving side (data reproducing apparatus) stores the data R in a memory (not shown). During repetitive reproducing, the transmitting side forwards only a message "Reproduced data Upon Lapse of Time Represented by Delta Time" without forwarding the data R. According to the message, when a predetermined time comes according to the delta time, the receiving side reads the data R out of the memory and reproduces it. By carrying out this operation thrice at t1, t2 and t3, the data amount to be transmitted is satisfactorily reduced to one-third.

Although exemplified herein was the case that the transmission data after once stored in a memory was reproduced, the method of FIG. 11 can be applied to the data reception of so-called a stream scheme where data is reproduced while being downloaded. In this case, the data R forwarded at t1 as a first reproducing time point will be stored in the memory.

Figure 12:
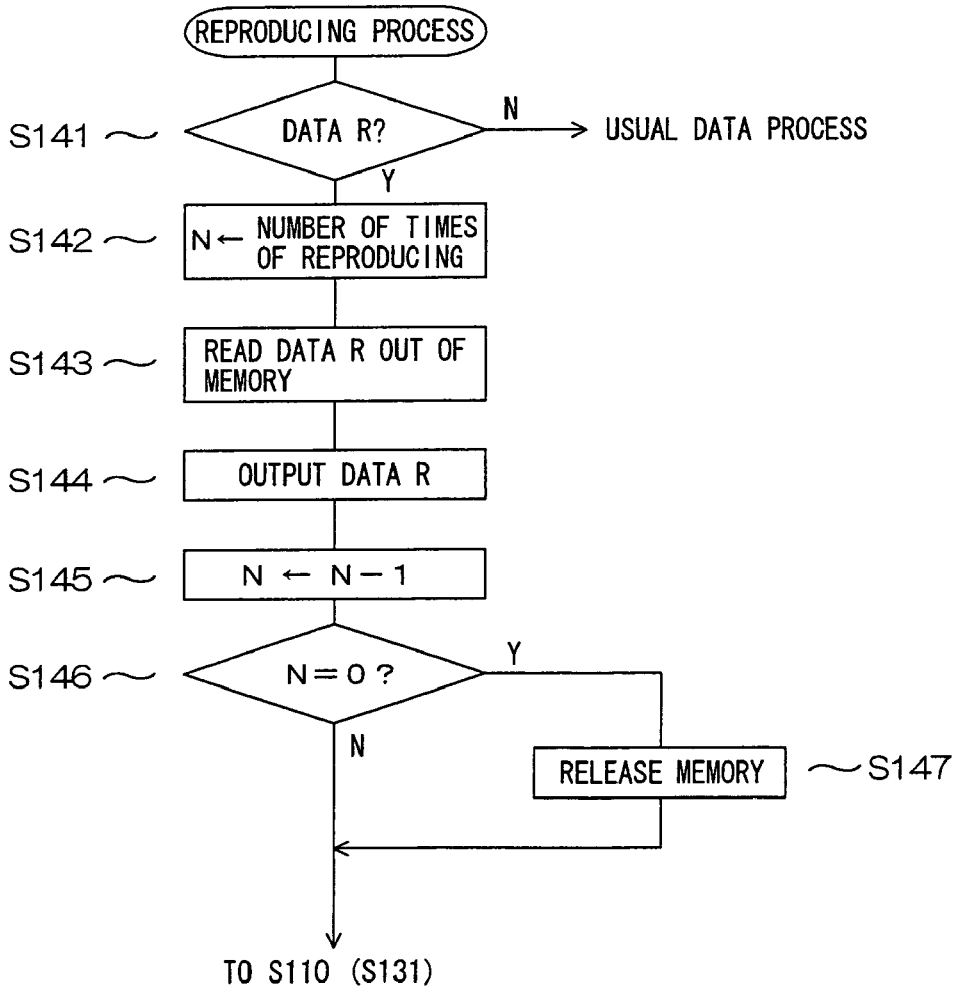
FIG. 12 is a flowchart of the repetitive reproducing process.

FIG. 12 is a flowchart showing a repetitive reproducing process described above, which is a detailed procedure in S112, S113 or S114 of FIG. 9 or a detailed procedure in S133, S134, S135 or S136 of FIG. 10. First, whether the received data is data R to be repetitively reproduced or not is determined (S141), wherein if the data is not repetitive data (S141 NO), processing is made as usual, or not repetitive, data. If it is repetitive data (S141 YES), the number of times of repetition is set to a counter N in the CPU (S142) and the data R is read out of the memory (S143) to output it (S144). Next, the counter N is subtracted by 1 thereby updating it into N−1 (S145). Then, whether the counter N has become 0 or not is determined (S146). If not 0 (S146 NO), processing moves to S110 of FIG. 9 or S131 of FIG. 10. If the counter N has become 0 (S146 YES), the data R recorded is erased to release or free the memory (S147).

Figure 13:
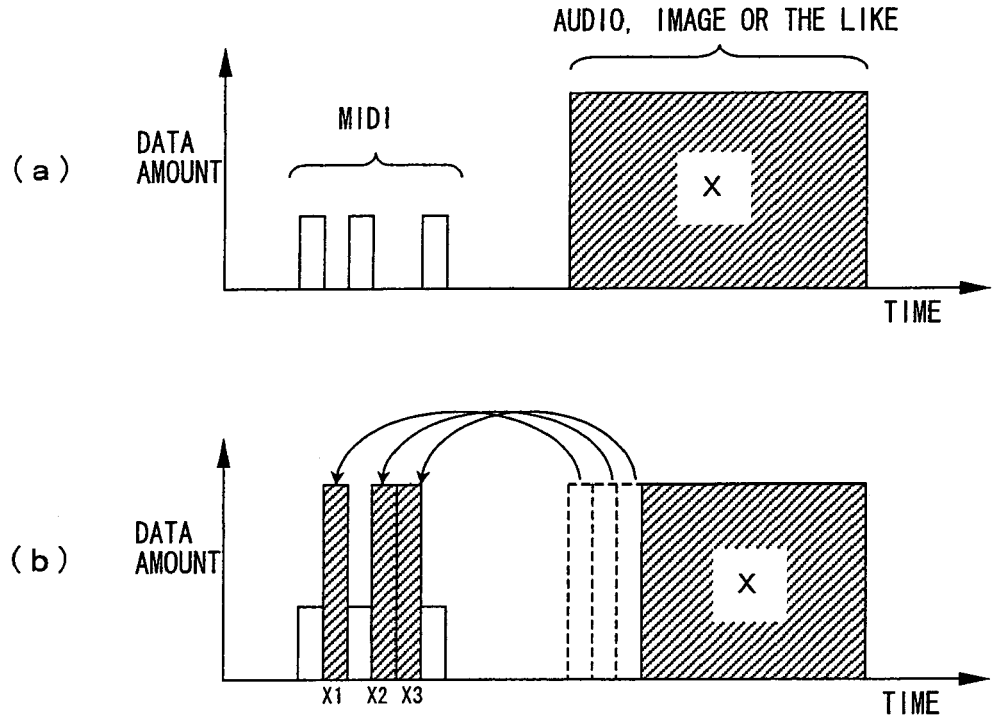
FIG. 13 is a figure showing the principle of previous forwarding of data.

FIG. 13 is a figure showing a principle of previously forwarding of data in a stream scheme. In the case of forwarding audio or image data following MIDI data, as shown in 13(*a*) the amount of data is less in the MIDI portion whereas the amount of data abruptly increases in the portion of audio or image data X. (The reason of less data amount of MIDI is that MIDI is not tone data itself but a command for controlling to generate tone and configured by binary data). Consequently, the data X if directly forwarded requires a great capacity of a communication line.

Accordingly, as shown in FIG. 13(*b*) the data X is appropriately divided to attach the IDs of X1, X2 and X3 to the divided data. The divisional data is inserted in the preceding MIDI data and previously forwarded, thereby making it possible to smoothen the amount of transmission data and reduce the capacity on the line. Although the example of partly dividing the data X was shown herein, the data may be divided throughout the entire section.

Figure 14:
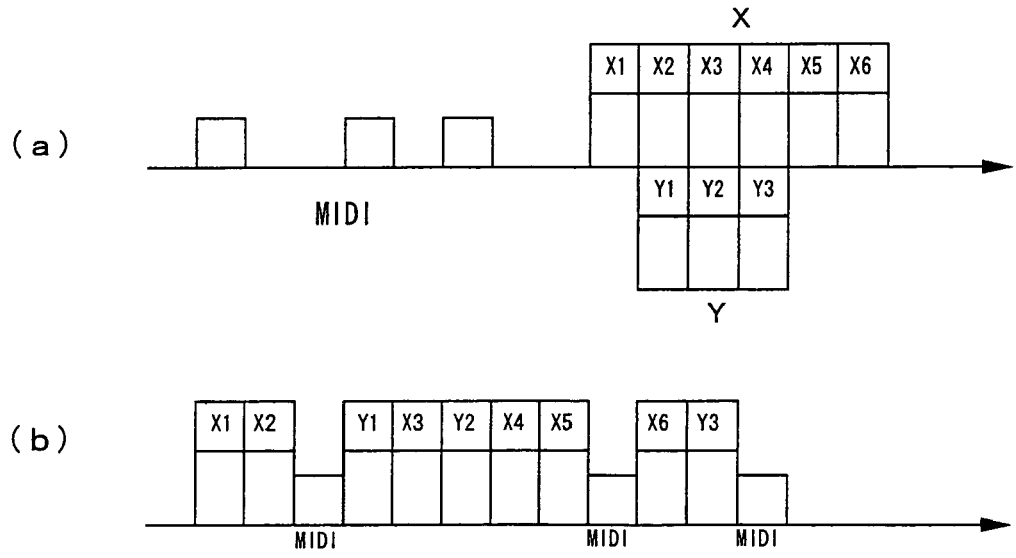
FIG. 14 is a figure showing an insertion example of divisional data.

The data following the MIDI may be a plurality of coexisting data X, Y as shown in FIG. 14(*a*). In also this case, the divisional data of the data X and data Y is each given an ID of X1, X2, . . . and Y1, Y2, . . . on an each-group basis. FIG. 14(*b*) shows an example that the divisional data are inserted between the preceding MIDI data. If a data group, having divisional data thus inserted therein, is received by the data receiving section 3, the divisional ones of inserted data are extracted from the data group. By combining the extracted divisional data, the former reproduced data is restored. The detail is explained with reference to FIG. 15 and FIG. 16.

Figures 15, 16:
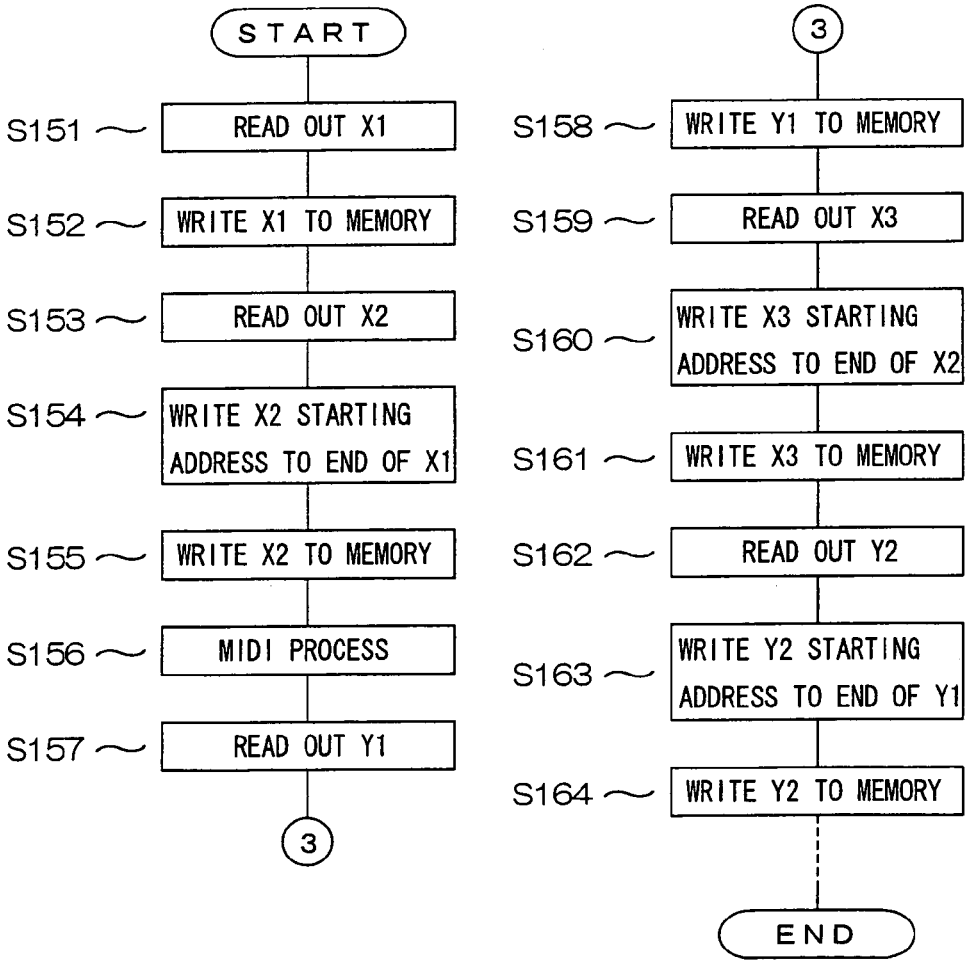
FIG. 15 is a figure showing the content of a memory storing divisional data.
FIG. 16 is a flowchart in the case of storing divisional data to a memory.

The received divisional data is separated from the MIDI data and sequentially stored to the memory in the chronological order of from the top data of FIG. 14(*b*). The content of the memory is shown in FIG. 15. In an area of each divisional data stored, a start address of a following one of divisional data to be coupled to the relevant divisional data is recorded on the each-group basis of X and Y. For example, a start address of data X2 is recorded in the end of data X1, and a start address of data X3 is recorded in the end of data X2. Also, a start address of data Y2 is recorded in the end of data Y1, and a start address of data Y3 is recorded in the end of data Y2.

FIG. 16 is a flowchart showing the operation to extract divisional data and store it to the memory in the case where the data receiving section 3 receives a data group of FIG. 14(*b*). First, the top data X1 is read in (S151), and the read data X1 is written to the memory (S152). Subsequently, data X2 is read in (S153), whereupon a start address of an area to store the data X2 is written to the end of the data X1 (S154) and then the data X2 is written to the memory (S155). Next, after processing the MIDI data (S156), data Y1 is read in (S157) and the read data Y1 is written to the memory (S158). Thereafter, data X3 is read in (S159) whereupon a start address of an area to store the data X3 is written to the end of the data X2 (S160) and then the data X3 is written to the memory (S161). Subsequently, data Y2 is read in (S162), whereupon a start address of an area to store the data Y2 is written to the end of the data Y1 (S163) and then the data Y2 is written to the memory (S164). Data X4 to data X6 are similarly written to the memory.

By thus recording the start addresses of the following ones of divisional data to the ends of the divisional data stored in the memory, the divisional ones of data can be easily combined for restoration. Namely, regarding the data X, the divisional ones of data X1, X2, . . . X6 are coupled in a chain form through the start addresses. Accordingly, even if the divisional data of the data X and the divisional data of the data Y are mixedly stored as in FIG. 15, the data X1, X2, . . . X6 are read out with reference to the start addresses and combined together, the former data X can be easily restored. This is true for the data Y.

Figure 17:
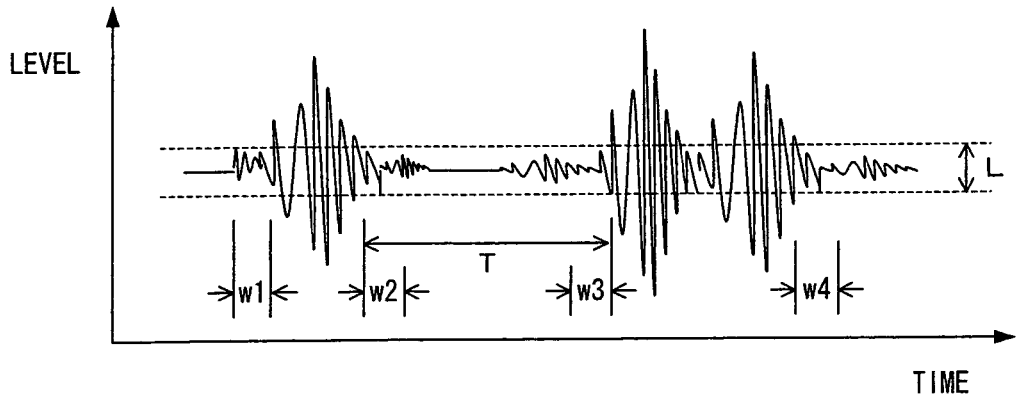
FIG. 17 is a waveform diagram of audio data having a silent section.

FIG. 17 is a figure explaining a process of the audio data having a silent section. For example, consideration is made on the case that the voice of an announcer is recorded as a audio signal and buried in an SMF format of FIG. 5(*b*) or FIG. 7(*b*). There possibly are pauses in the midway of announcer's voice. The data in the pause section (silent section) is unnecessary data. Accordingly, if the silent sections of data are cut to embed only the required portions in the SMF format, the amount of data can be reduced.

In the audio signal of FIG. 17, a section T is a silent section. Although the silent section T is a section having inherently a signal level of 0, actually the level is not necessarily limited to 0 because of mixing-in of noise or the like. Accordingly, a level value L in a constant range is fixed so that, where a section that the signal level does not exceed L continues in a constant section, this section is defined as a silent section T to create audio data where the silent sections T are cut away. If this is embedded in the SMF format of FIG. 5(*b*) or FIG. 7(*b*) and reproduced according to the foregoing reproducing method, the amount of transmission data is satisfactorily less and the memory capacity on the receiving side can be economized.

However, by merely cutting away of the silent sections T, during reproducing the signal sharply rises and falls thereby causing noise. In order to avoid this, a fade-in/out process is desirably carried out at around a signal rise and fall to obtain a smooth rise/fall characteristic. The fade-in/out process can be easily realized by a known method using a fade-in/out function. In FIG. 17, W1–W4 are regions that the fade-in/out process is to be carried out.

Figure 18:
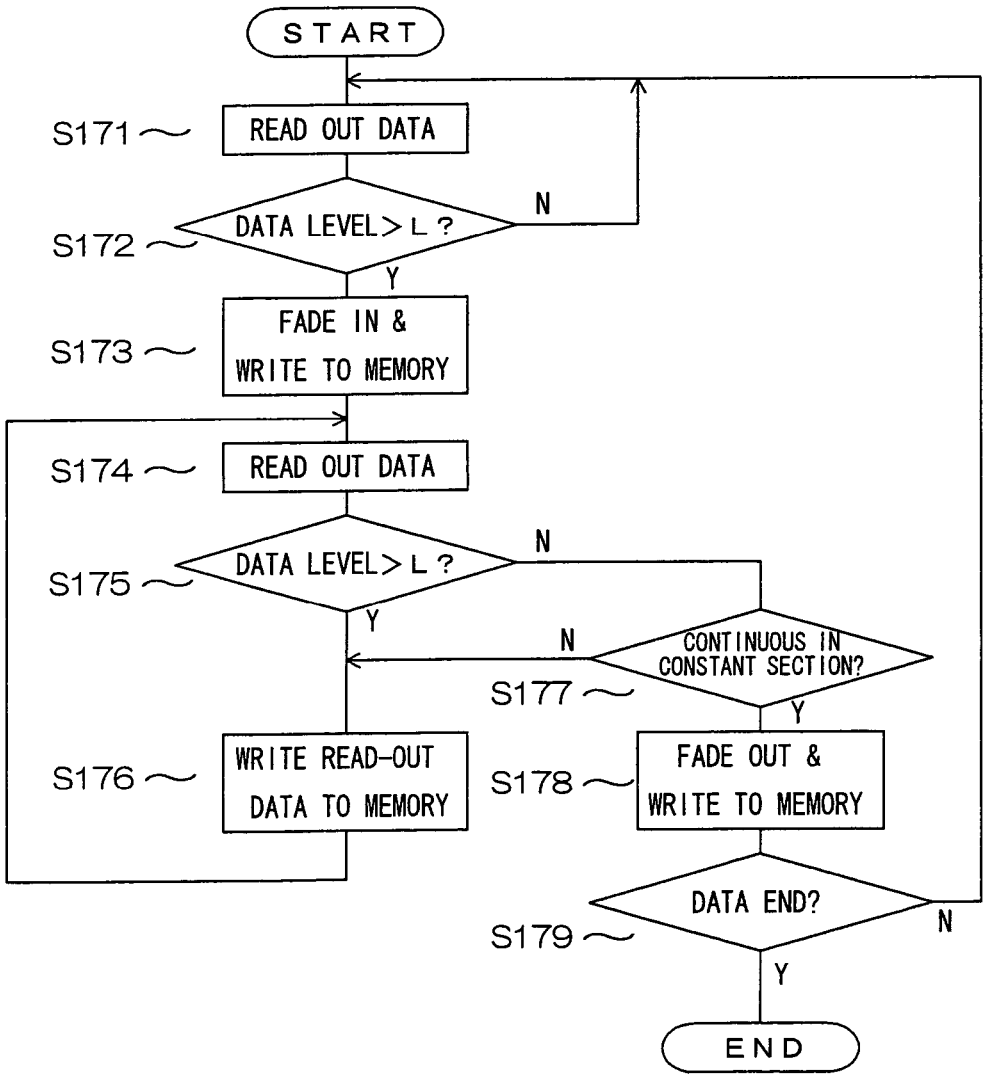
FIG. 18 is a flowchart showing a process of silence sections.

FIG. 18 is a flowchart in the case the silent sections are cut away to record the data. Data is read sequentially from the top (S171), and whether the level of the read data exceeds a constant value or not (S172) is determined. If the constant value is not exceeded (S172 NO), S171 is returned to subsequently read the data. If the constant value is exceeded (S172 YES), the foregoing fade-in/out process is carried out at around a rise in the data and the data after the process is written to the memory (S173). The fade-in/out process herein is a fade-in/out process in W1 of FIG. 17, which is a fade-in process that the signal rises moderately.

Next, data is read in again (S174), and whether the level of the read data exceeds a constant value or not is determined (S175). If the constant value is exceeded (S175 YES), the data is written to the memory (S176) and S174 is returned to read the next data. If the constant value is not exceeded (S175 NO), it is determined whether the section has a continued constant section or not (S177). If the section does not have a continued constant section (S177 NO), the data is written to the memory (S176) and S174 is returned to read the next data. If a section has a constant level that is not exceeded and includes a continued constant section (S177 YES), the section is considered as a silent section so that a fade-in/out process is made in the region W2 in FIG. 17 and the data after the process is written to the memory (S178). The fade-in/out process herein is a fade-out process that the signal falls moderately. In S178 a process is carried out to erase the unnecessary data in the silent sections among the data written in S176.

Next, whether data reading is ended or not is determined (S179). If not ended (S179 NO), processing is returned to S171 to read in the next data. The similar processes to the above are passed to carry out a fade-in/out process in W3, W4 of FIG. 17. If the data reading is ended (S179 YES), the operation is ended.

In the above embodiment, audio, text and images are taken as information to be embedded in an SMF extended format. However, the embedded information may be anything, e.g. a computer program is satisfactory. In this case, if a computer program is provided to be reproduced following MIDI data, a music according to the MIDI is first played and, when this is ended, the program is automatically run.

Also, although the above embodiment showed the example that data is received from a file 1*a* of a server on a network through a communication line, it is satisfactory to create SMF-type data on a personal computer and store it in a file 1*b* on the hard disk so as to download the data therefrom.

Figure 19:
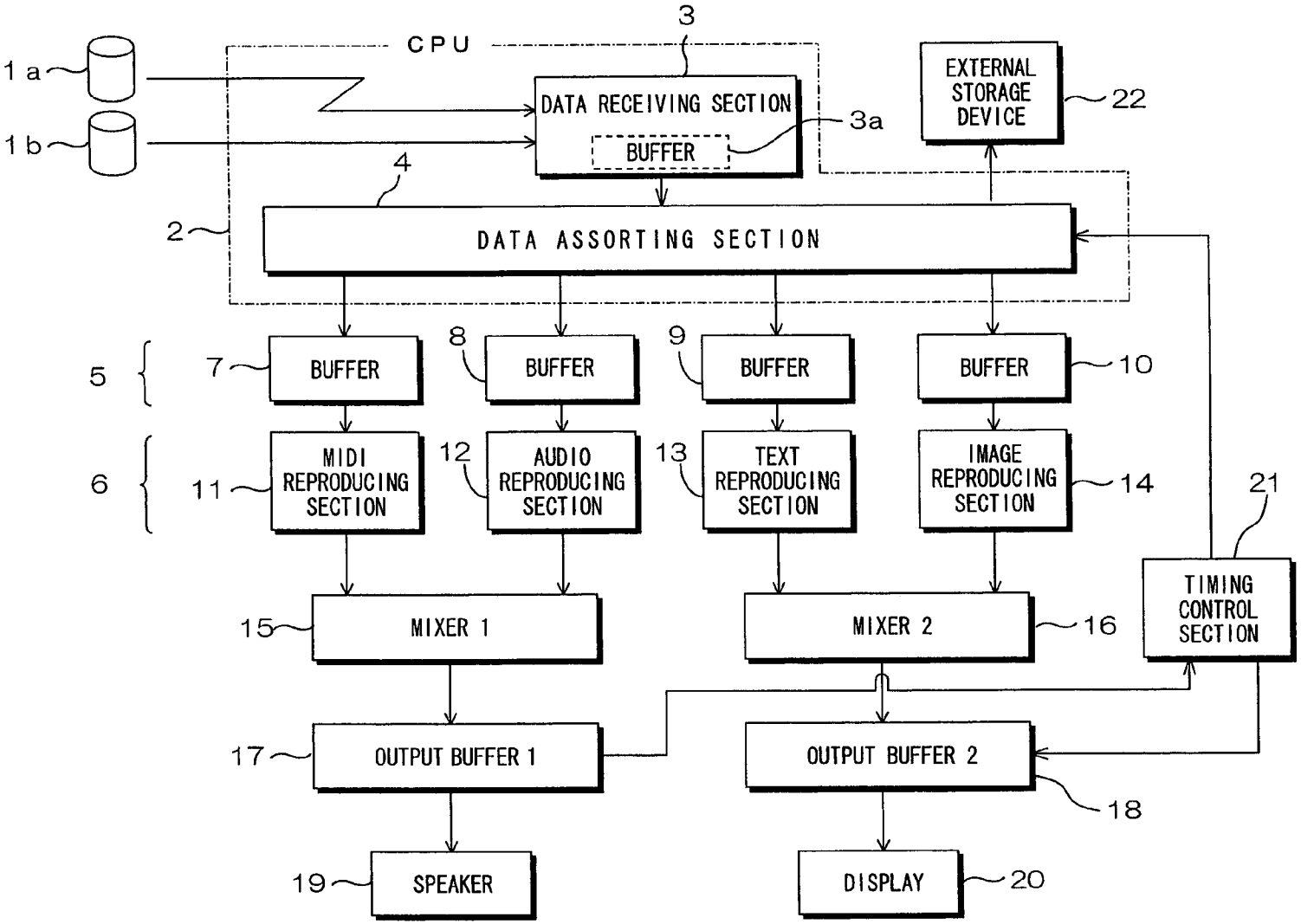
FIG. 19 is a block diagram showing another example of a data reproducing apparatus of the invention.

FIG. 19 shows another example of a data reproducing apparatus according to the invention. 1*a*, 1*b* are files on which data is recorded. 1*a* is, for example, a file in a server on the Internet, and 1*b* is, for example, a file on a hard disk within the apparatus.

2 is a CPU for controlling the overall of the data reproducing apparatus, which is configured to include a data receiving section 3 and a data sorting section 4. Besides these blocks, the CPU 2 includes other blocks having various functions. However, they are not directly related and thus this discussion is omitted. The data receiving section 3 accesses the files 1*a*, 1*b* to receive the data stored in these. The data of the file 1*a* is received through a wire or wirelessly. The format of the data to be received is the same as FIG. 2 to FIG. 8. These received data are temporarily stored in a buffer 3*a*. The data sorting section 4 sorts the data received by the data receiving section 3 based on data type and stores them in the buffers 7–10 constituting a storage section 5.

6 is a data reproducing section configured with a MIDI reproducing section 11 for processing the data concerning MIDI, an audio reproducing section 12 for processing the data concerning audio, a text reproducing section 13 for processing the data concerning text, and an image reproducing section 14 for processing the data concerning images. Although not shown, the MIDI reproducing section 11 has a sound-source ROM 11*a* of FIG. 1. The image reproducing section 14 has a function to reproduce still images and motion images.

15 is a mixer for mixing the outputs of the MIDI reproducing section 11 and audio reproducing section 12, and 16 is a mixer for mixing the output of the text reproducing section 13 and image reproducing section 14. Although herein not shown, the mixer 15 has a sound-effect section 15*a* of FIG. 1 while the mixer 16 has a visual-effect section 16*a* of FIG. 1. 17 is an output buffer to temporarily store the output of the mixer 15, and 18 is an output buffer to temporarily store the output of the mixer 16. 19 is a speaker as a sound generating section to output sound on the basis of the data of the output buffer 17, and 20 is a display for displaying visual information, such as characters and illustrations, on the basis of the data of the output buffer 18. 21 is a timing control section for generating a system clock providing a reference time to control the timing of each section, and 22 is an external storage device to be externally attached to the data reproducing apparatus.

The storage section 5, the data reproducing section 6, the mixers 15, 16, the output buffers 17, 18 and the timing control section 21 are configured by a DSP (Digital Signal Processor). The above sections can be configured by a LSI, in place of the DSP.

As apparent from a comparison between FIG. 19 and FIG. 1, the data reproducing apparatus of FIG. 19 has a storage section 5 comprising buffers 7–10 between the data sorting section 4 and the data reproducing section 6, and also has a timing control section 21. Furthermore, an external storage device 22 is also added.

Figure 20:
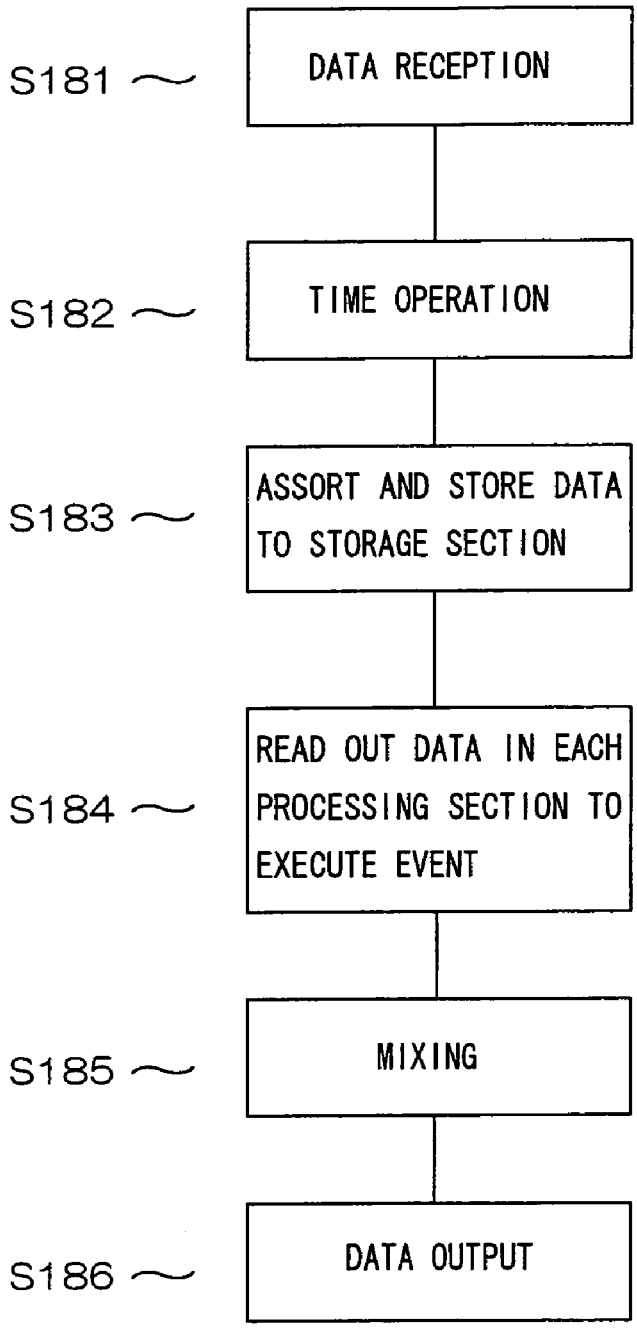
FIG. 20 is a flowchart showing another example of a data reproducing method of the invention.

FIG. 20 is a flowchart showing the overall operation of the data reproducing apparatus of FIG. 19. First, the data receiving section 3 receives data from the file 1*a* or file 1*b* (S181). This received data is stored to the buffer 3*a*. Next, the CPU 2 carries out a time operation required for data sorting by the data sorting section 4 on the basis of the system clock from the timing control section 21 and delta time of each of data received by the data receiving section 3 (S182). The detail of S182 will be hereinafter referred to. The data sorting section 4 sorts the data to be processed based on data type depending upon a result of time operation, and stores them to the corresponding buffers 7–10 (S183). The detail of S183 will also be hereinafter referred to.

The data stored in the buffer 7–10 is read out by the data reproducing section 11–14 corresponding to each buffer so that the event recorded in the data is executed in each data reproducing section 11–14 thereby reproducing the data (S184). The detail of S184 will be hereinafter referred to. Among the reproduced data, the data of MIDI and audio is mixed in the mixer 15 while the data of text and images is mixed in the mixer 16 (S185). The mixed data are respectively stored in the output buffers 17, 18 and thereafter outputted to the speaker 19 and the display 20 (S186).

Figure 21:
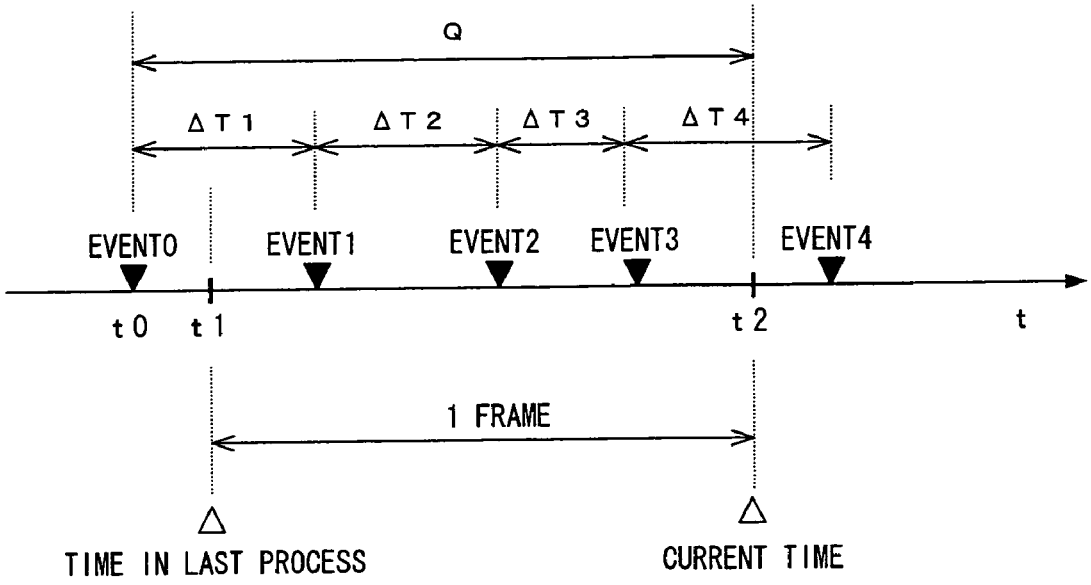
FIG. 21 is a figure explaining the principle of time operation in data sorting.

FIG. 21 is a figure explaining a principle of time operation in S182. In the figure, t is a time axis and an event 0 to event 4 show the timing of reproducing an event included in a received data row (it should be noted that this reproducing timing represents a timing in the case that the received data is assumed to be reproduced according to a delta time thereof, instead of representing an actually reproduced timing on the time axis t). For example, the event 0 is an image event, the event 1 is a MIDI event, the event 2 is an audio event, the event 3 is a text event, and the event 4 is an image event. ΔT1 to ΔT4 are a delta time, wherein ΔT1 is a delta time of the event 1, ΔT2 is a delta time of the event 2, ΔT3 is a delta time of the event 3, and ΔT4 is a delta time of the event 4. As in the foregoing, the delta time is a time from a time point of executing the immediately preceding event to an execution of the current event. For example, the event 2 is executed upon elapsing ΔT2 from the time point of executing the event 1, and the event 3 is executed upon elapsing ΔT3 from the time point of executing the event 2. t1 represents a time that the last-time data has been processed, and t2 represents a current time. The difference t2–t1 corresponds to one frame as a unit section. This one-frame section has a time width, for example, of 15 ms. The first and last timings in one frame are determined by the system clock from the timing control section 21 (see FIG. 19). Q is a data processing section, which is defined as a difference between a current time t2 and an execution time t0 of the last event in a frame preceded by one (event 0).

Figure 22:
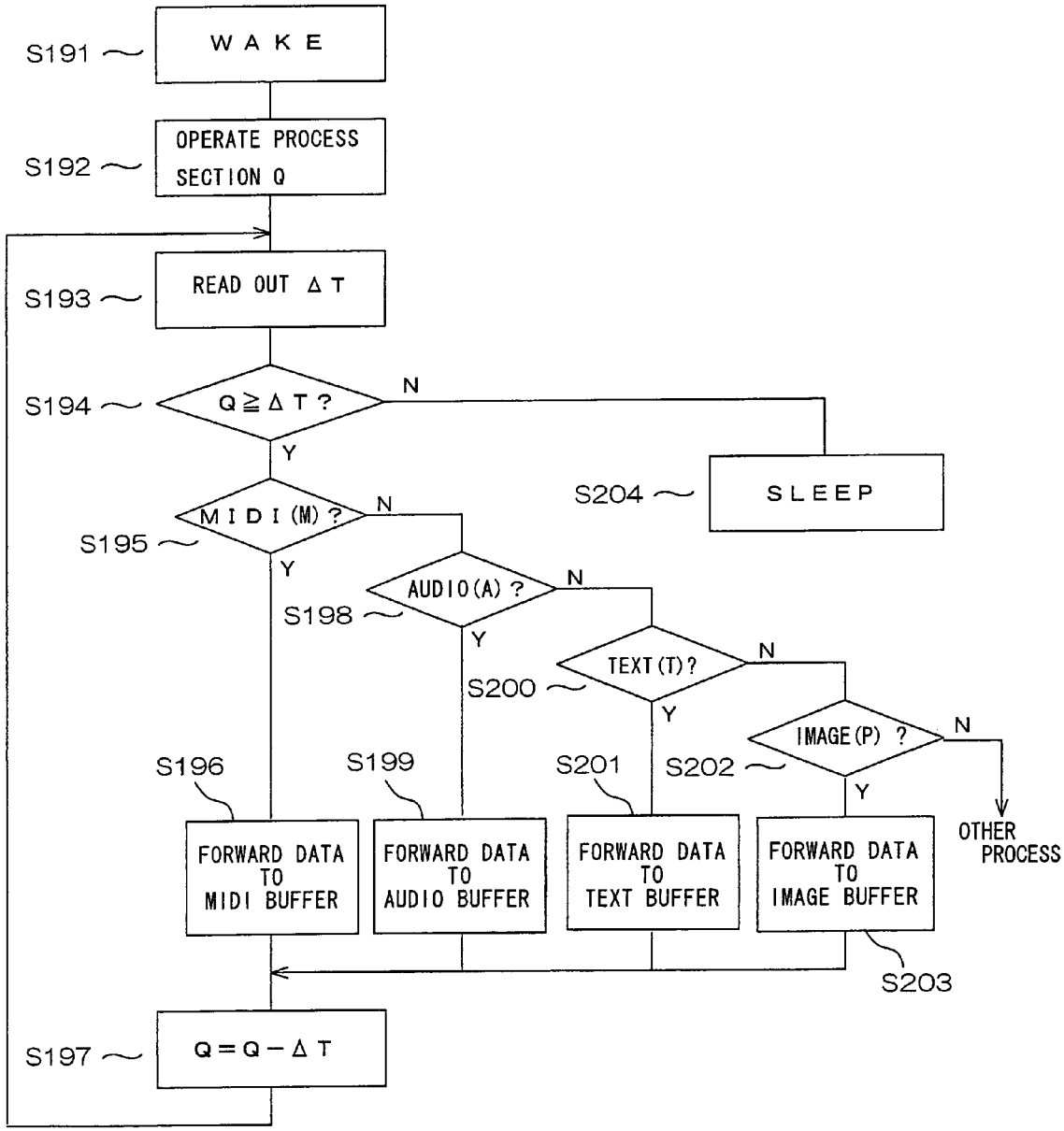
FIG. 22 is a flowchart showing a procedure of data sorting.

FIG. 22 is a flowchart showing a procedure of data sorted by the data sorting section 4. Hereunder, explanation is made on the procedure of sorting data, with reference to FIG. 21 and FIG. 22. In the timing t2 of FIG. 21, if there is a clock interrupt from the timing control section 21 to the CPU 2, the system becomes a WAKE state (S191) so that the CPU 2 operates a time width of a process section Q (S192). This Q, as in the foregoing, is calculated as:

$$Q=t2-t0,$$

which represents a time width for processing the current data. Next, the CPU 2 sequentially reads a delta time ΔT of the received data (S193) to determine whether the time width of the process section Q is equal to or greater than ΔT or not (S194). If Q≧ΔT (S194 YES), data kind determinations are next made in order (S195, S198, S200, S202), where the data is sorted and stored to the buffers 7–10 corresponding to the respective types of data (S196, S199, S201, S203). Thereafter, Q=Q−ΔT is operated to update the value of Q (S197).

In the example of FIG. 21, because the event 0 has been already processed in the last time, determination is made in order from the event 1. Concerning the delta time ΔT1 of the event 1, because of Q>ΔT1, the determination in S194 is YES and next whether the data is MIDI or not is determined (S195). In FIG. 21, if the event 1 is a MIDI event (S195 YES), the data is forwarded to and temporarily stored in the buffer 7 (S196). If the event 1 is not a MIDI event (S195 NO), whether an audio event or not is determined (S198). If the event 1 is an audio event (S198 YES), the data is forwarded to and temporarily stored in the buffer 8 (Sl99). If the event 1 is not an audio event (S198 NO), whether a text event or not is determined (S200). If the event 1 is a text event (S200 YES), the data is forwarded to and temporarily stored in the buffer 9 (S201). If the event 1 is not a text event (S200 NO), whether an image event or not is determined (S202). If the event 1 is an image event (S202 YES), the data is forwarded to and temporarily stored in the buffer 10 (S203). If the event 1 is not an image event (S202 NO), another process is carried out.

In this manner, the data of the event 1 is sorted to any of the buffers 7–10, and thereafter Q=Q−ΔT1 is operated (S197). Returning to S193, a delta time ΔT2 of the next event 2 is read to determine Q≧ΔT2 (S194). Although the value of Q at this time is Q=Q−ΔT1, because Q−ΔT1>ΔT2 in FIG. 21, the determination in S194 is YES. Similarly to the above, data type determinations of the event 2 are made for sorting into the corresponding buffers.

Thereafter, Q=Q−ΔT2 is operated (S197). Returning to S193, a delta time ΔT3 of the next event 3 is read to determine Q≧ΔT3 (S194). Although the value of Q at this time is Q= Q−T1−ΔT2, because of Q−ΔT1−ΔT2>ΔT3 in FIG. 21, the determination in S194 is YES. Similarly to the above, data type determinations of the event 3 are made for sorting to the corresponding buffers.

Thereafter, Q=Q−ΔT3 is operated (S197). Returning to S193, a delta time ΔT4 of the next event 4 is read (Although in FIG. 21 the event 4 is shown later than t2, the data of the event 4 at a time point t2 has already entered the buffer 3*a* and is possible to read out) to determine Q≧ΔT4 (S194). Although the value of Q at this time is Q=Q−ΔT1−ΔT2−ΔT3, because of Q−ΔT1−ΔT2−ΔT3<ΔT4 in FIG. 21, the determination in S194 is NO. The CPU 2 does not carry out data processing of the event 4 but enters a SLEEP state to stand by until the process in the next frame (S204). Then, if there is a clock interrupt in the first timing of the next frame from the timing control section 21, a WAKE state is entered (Sl91), whereby the data of the event 4 and the subsequent data are processed similarly to the foregoing process.

In the flowchart of FIG. 22, S192–S194 and S197 are the details of S182 of FIG. 20, and S195, S196 and S198–S203 are the details of S183 of FIG. 20.

Figure 23:
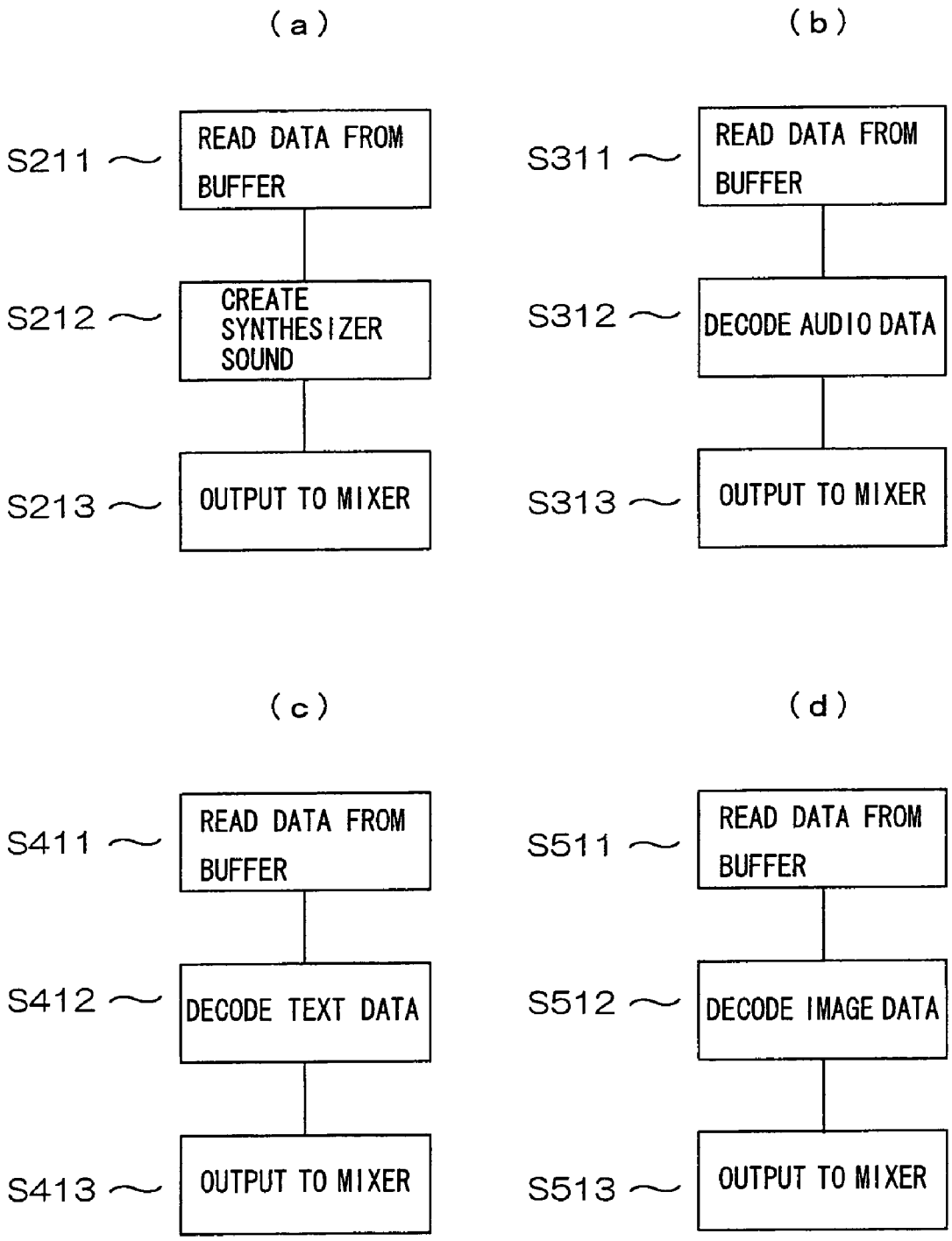
FIG. 23 is a flowchart showing the operation of each data reproducing section.

Next, explanation is made on the detail of each data reproducing section 11–14, i.e. the detail of S184 of FIG. 20. FIG. 23 is a flowchart showing a process procedure in each data reproducing section, wherein 23(*a*) represents a process procedure in the MIDI reproducing section 11. In the MIDI reproducing section 11, when the data of one-frame section sorted by the data sorting section 4 is stored to the buffer 7, this data is read in the next one-frame section (S211). Then, the content of a MIDI event recorded in the read data (see FIG. 3, FIG. 4) is decoded to create a synthesizer sound by a software synthesizer (S212). The output of the synthesizer is temporarily stored in a not-shown buffer present within the MIDI reproducing section 11, and outputted to the mixer 15 from this buffer (S213).

FIG. 23(*b*) shows a process procedure in the audio reproducing section 12. In the audio reproducing section 12, when the data of one-frame section sorted by the data sorting section 4 is stored to the buffer 8, this data is read in the next one-frame section (S311). Then, the audio data recorded in an event of the read data (see FIG. 5(*b*), FIG. 7(*b*)) is decoded to reproduce an audio (S312). The reproduced data is temporarily stored in a not-shown buffer present within the audio reproducing section 12, and outputted to the mixer 15 from this buffer (S313).

FIG. 23(*c*) shows a process procedure in the text reproducing section 13. In the text reproducing section 13, when the data of one-frame section sorted by the data sorting section 4 is stored to the buffer 9, this data is read in the next one-frame section (S411). Then, the text data recorded in an event of the read data (see FIG. 5(*c*), FIG. 7(*c*)) is decoded to reproduce a text (S412). The reproduced data is temporarily stored in a not-shown buffer present within the text reproducing section 13, and outputted to the mixer 16 from this buffer (S413).

FIG. 23(*d*) shows a process procedure in the image reproducing section 14. In the image reproducing section 14, when the data of one-frame section sorted by the data sorting section 4 is stored to the buffer 10, this data is read in the next one-frame section (S511). Then, the image data recorded in an event of the read data (see FIG. 5(*d*), FIG. 7(*d*)) is decoded to reproduce an image (S512). The reproduced data is temporarily stored in a not-shown buffer present within the image reproducing section 14, and outputted to the mixer 16 from this buffer (S513).

Each process of FIGS. 23(*a*)–(*d*) stated in the above is carried out according to a sequence determined by a program, herein assumably carried out in the sequence of 23(*a*) to 23(*d*). Namely, the MIDI process of 23(*a*) is first made. If this is completed, the audio process of 23(*b*) is entered. If the audio process is completed, the text process of 23(*c*) is entered. If the text process is completed, the image process of 23(*d*) is made. The reason for carrying out the processes in a series fashion is that the DSP constituting the storage section 5, the data reproducing section 6 and the like is one in the number. Where a DSP is provided in each reproducing section, the process can be made in a parallel fashion.

The MIDI reproduced data outputted to the mixer 15 in S213 and the audio reproduced data outputted to the mixer 15 in S313 are mixed together in the mixer 15 and stored to the output buffer 17, thereby being outputted as a sound from the speaker 19. Also, the text reproduced data outputted to the mixer 16 in S413 and the image reproduced data outputted to the mixer 16 in S513 are mixed together in the mixer 16 and stored to the output buffer 18, thereby being displayed as visual information on the display 20. The output buffer 17 and the speaker 19 constitute a first output section, while the output buffer 18 and the display 20 constitute a second output section. The output buffer 17 has a function to count the number of the data to be outputted to the speaker 19. On the basis of this count value, the output buffer 17 supplies a control signal to the timing control section 21. The timing control section 21 supplies a timing signal (system clock) to the CPU 2 on the basis of the control signal. Namely, the time required in outputting the data of one in the number from the output buffer 17 is determined by a sampling frequency. If this time is given τ, the time required in outputting the data of N in the number is N×τ. Accordingly, the timing can be determined by a value of N. Meanwhile, the timing control section 21 also supplies the timing signal to the output buffer 18 according to the control signal, to control the timing of the data to be outputted from the output buffer 18.

Figure 24:
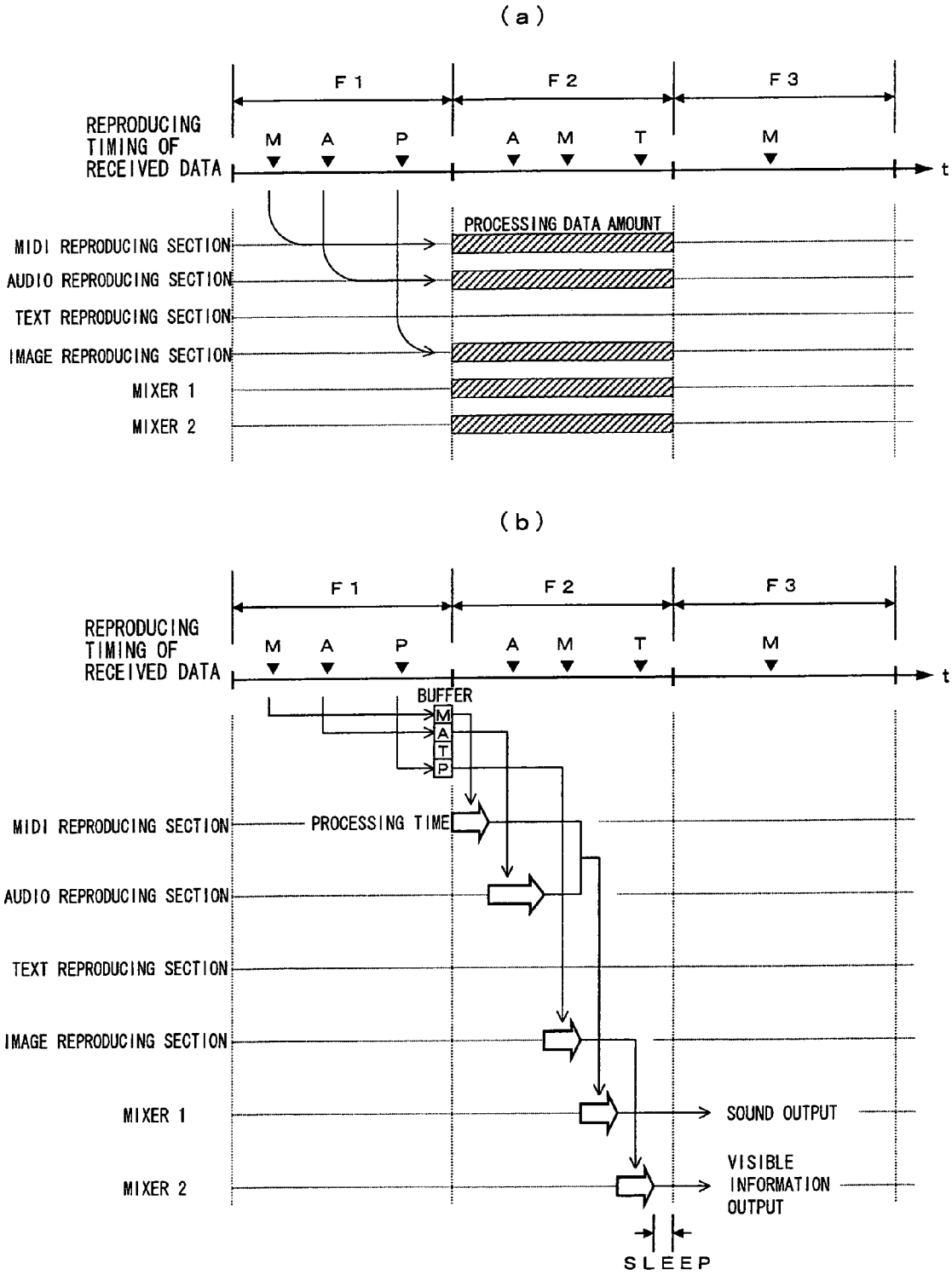
FIG. 24 is a time chart of a data process overall.

FIG. 24 is a figure showing in an overall fashion the foregoing operation from data sorting to reproducing, wherein (a) represents a relationship between an amount of data to be processed in each reproducing section and a frame section and (b) represents a relationship between a process time in each reproducing section and a frame section. F1–F3 are one-frame sections, wherein the time width of each frame section is set, for example, at 15 ms. Namely, the data sorting section 4 is interrupted by a clock at a time interval of 15 ms from the timing control section 21. t represents a time axis, M represents a reproducing timing of a MIDI event, A represents a reproducing timing of an audio event, T represents a reproducing timing of a text event and P represents a reproducing timing of an image event. These reproducing timings show the timings on the assumption that the received data be reproduced according to a delta time similarly to FIG. 21, instead of showing the timings that actual reproducing is made on the time axis t.

As was explained in FIG. 21, the data to be processed in a section F1 is sorted and stored to the buffers 7–10 in the last timing of the same section. Each reproducing section 11–14 reads data from the buffer in the next one-frame section F2 to carry out a reproducing process. In this case, the amount of data to be transferred from each buffer to each reproducing section is data in an amount that each reproducing section can process in the one-frame section. As shown in FIG. 24(*a*), each reproducing section is made to process all the data within the next one-frame section F2.

The time chart of this process is FIG. 24(*b*), wherein the length of a white arrow represents a process time. The process time is different depending on each frame. As in the foregoing, the data stored in the buffer, in the next one frame section F2, is sequentially read out in a predetermined order by each reproducing section 11–14, so that in each reproducing section an event recorded in the data is executed thereby reproducing the data. In FIG. 24(*b*), M (MIDI), A (audio) and P (image) are reproduced and processed in this order. The reproduced M and A are processed in a mixer 1 (mixer 15 in FIG. 19) while the reproduced P is processed in a mixer 2 (mixer 16 in FIG. 19). In this manner, the data sorted in the section F1 is all completed in process within the section F2. The remaining time is a standby time before starting a process in a section F3. This is shown by SLEEP in the figure. The output from the mixer 1 is stored in an output buffer 1 (output buffer 17 in FIG. 19) and thereafter outputted as a sound in the next frame section F3. Meanwhile, the output from the mixer 2 is stored to an output buffer 2 (output buffer 18 in FIG. 19) and thereafter outputted as visual information in the frame section F3.

Similarly, in the section F2, the data A, M, T is sorted to the buffer. The data is read out in the order of M, A and T in the section F3, reproduced and processed in the same procedure as the above in each reproducing section and outputted in the next section F4 (not shown in FIG. 24).

In the above manner, in the data reproducing apparatus of FIG. 19, the received data is sorted on a frame-by-frame basis and stored to the buffer, and read out from the buffer in the next frame to reproduce the data, and outputted as a sound or visual information in the next frame. Accordingly, reproducing can be made while taking time synchronization of data on a frame-unit basis.

Meanwhile, the data sorting section 4 is devoted to the operation of sorting the received data to the buffers 7–10, and each reproducing section 11–14 is devoted to reading out and reproducing the data stored in the buffer. Accordingly, it is possible to make the data received by the data receiving section 3 into a pipeline form and process it at high speed.

In reproducing data, the timing of reproducing should be primarily controlled according to delta time. However, in the apparatus of FIG. 19, after data is sorted to the buffers 7–10 by the data sorting section 4, the data is separated and hence the individual delta time is substantially insignificant in determining a reproducing timing. However, because one frame section as above is an extreme short time of 15 ms, it is satisfactory to consider that the data reproduced in this duration has been simultaneously reproduced regardless of the reproducing timing of each of data. It is empirically ascertained that the deviation in data reproducing timing within a section of nearly 15 ms cannot be distinguished by a usual human sense. Accordingly, upon sorting data to determine that data is to be processed within one frame section on the basis of delta time, there is no problem even where, within one frame section, the reproducing timing of the data is deviated from the reproducing timing according to delta time.

Furthermore, it is satisfactory that the order of reproducing different kinds of data be changed within the same frame section. For example, although each reproducing section reads data from the buffer according to the order of M, A and P of the received data in the F1 section of FIG. 24(*b*), in the section F2 the order the reproducing sections reads data out of the buffers is M, A and T, i.e., A and M exchanged despite the order of received data is A, M and T. This is because, as described before, the process order in each reproducing section is fixed as M, A, T and P by a program. However, even if the process order is changed in this manner, if each reproducing section carries out data processing within 15 ms, there is no problem because the reproducing timing of data is not known by a human sense as described before.

Meanwhile, although in FIG. 24 the data sorted in the one frame section is all processed within the next one frame section, this is not essentially required. In other words, if the output buffers 17, 18 have a size exceeding the processing amount in one frame section, even where there is data which has not been processed within the one frame, the earlier-processed data is left in the output buffers 17, 18 and the data can be outputted without suspension.

Figure 25:
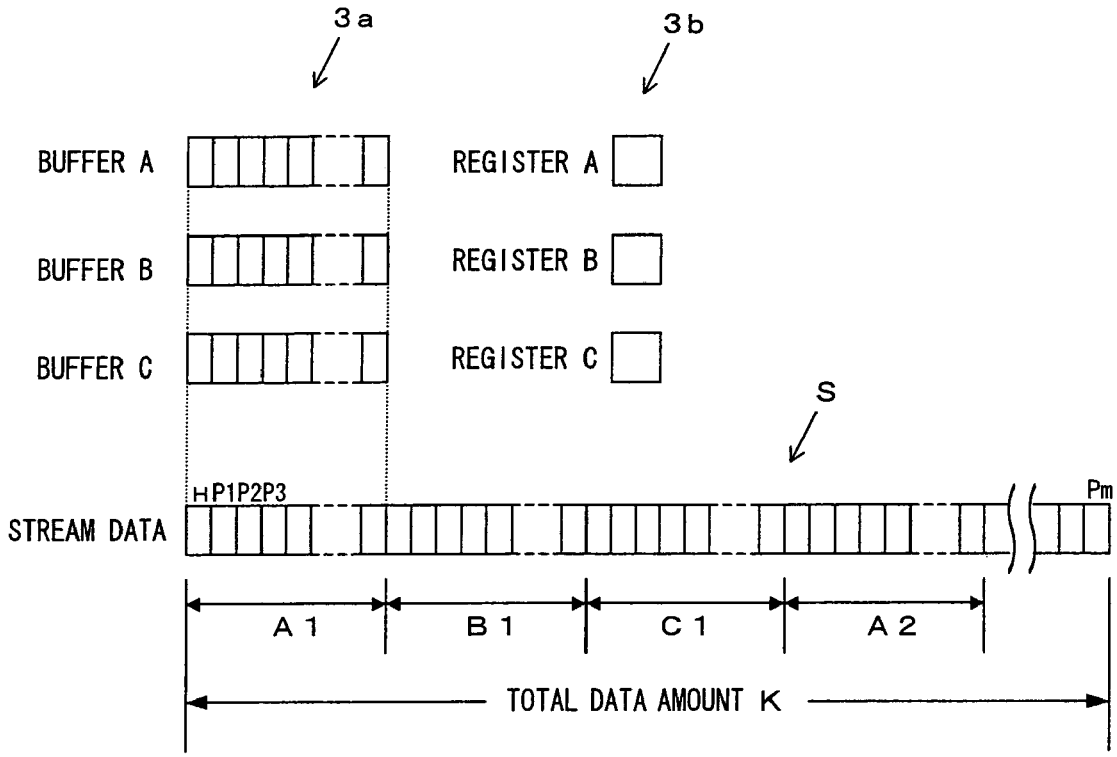
FIG. 25 is a figure explaining the operation of data reception in a stream scheme.

FIG. 25 explains the operation of the data receiving section 3 wherein a stream scheme carries out reproducing while downloading data in the data reproducing apparatus of FIG. 1 or FIG. 19. Herein, a buffer 3*a* is configured by three buffers of buffer A, buffer B and buffer C. 3*b* is registers A, B, C corresponding to the buffers A, B, C. The data to be received is shown as data stream S. The data stream S has a header H recorded at its top. Following this, MIDI, audio, text and images of data are mixedly recorded as packets P1, P2, P3, . . . Pm. The total data amount of the data stream S is K.

Hereunder, explanation is made on the receiving operation with an example in the case of reproducing music. When the data receiving section 3 starts to receive data stream S from the file 1*a* due to access to the server, the data A1 in an amount corresponding to a buffer A size (capacity) is first stored from the top of the data stream S to the buffer A. This sets the buffer A to a full state, and sets the register A with a flag representative of a full state of the buffer A. Subsequently, the data B1 in an amount corresponding to a size of the buffer B is stored to the buffer B. This also sets the buffer B to a full state, and sets the register B with a flag representative of a full state of the buffer B.

When buffer B become full, the data sorting section 4 starts to sort data, thereby transferring the data A1 stored in the buffer A and the data B1 stored in the buffer B to the buffer 7–10 based on data type. The transferred data is reproduced by each reproducing section 11–14, starting to play music. On the other hand, the data C1 is stored to the buffer C in an amount corresponding to the size thereof. This sets the buffer C to a full state, and sets the register C with a flag representative of a full state of the buffer C.

Figure 26:
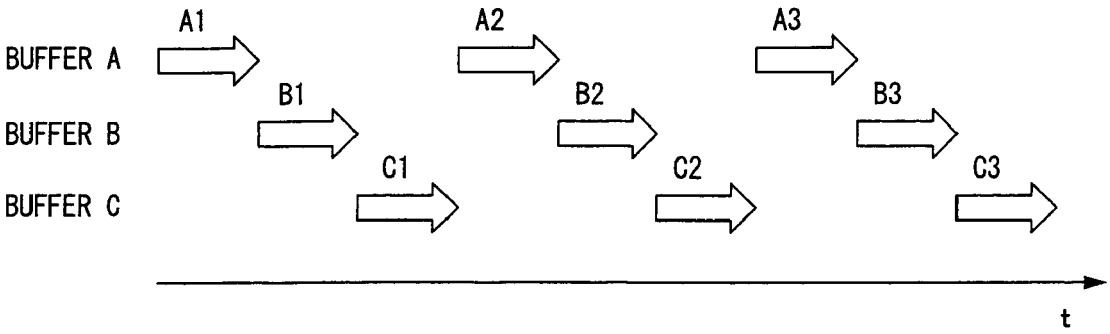
FIG. 26 is a time chart of data reception.

During storage of data C1 in the buffer C, if the data A1 of the buffer A is consumed to make the buffer A empty, a flag of the register A is reset. The data receiving section 3 acquires the next data A2 and stores it to the buffer A. This sets the buffer A again to a full state, and sets a flag in the register A. Meanwhile, if the data B1 of the buffer B is consumed to make the buffer B empty, a flag of the register B is reset. The data receiving section 3 acquires the next data B2 (not shown in FIG. 25) and stores it to the buffer B. This makes the buffer B again in a full state, to set a flag in the register B. By repeating the above operation, the reproducing of data stream S proceeds. FIG. 26 is a figure showing a flow of data in this case.

In the above stream scheme, it is possible to start reproducing from a time point of receiving the data A1. However, where the transfer capacity of the data to be fetched to the buffer is insufficient, after a reproducing start, the data supply to the buffer does not catch up with consumption, thus causing a phenomenon of discontinuity in sound. Accordingly, in order to avoid this, there is a need of caching data to the buffer to start reproducing at a time point when a certain amount of data is saved. This will be explained as an example in FIG. 27.

Figure 27:
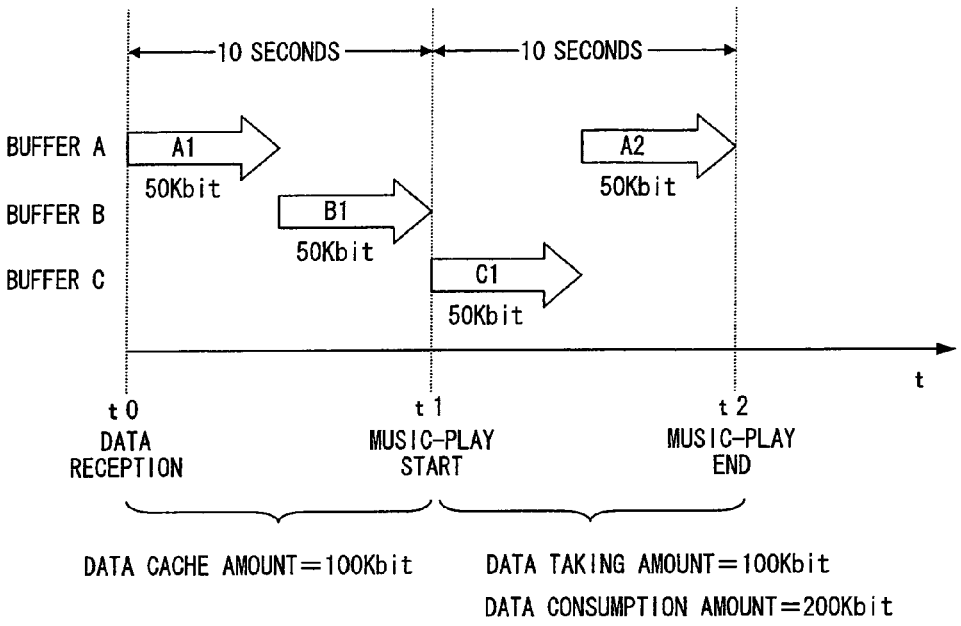
FIG. 27 is a time chart explaining data cache.

Assuming in FIG. 27 that the buffers A, B, C are respectively in size of 50 K-bits and the time required in fetching data to the buffer is 5 seconds, the data transfer capacity per second is given 50/5=10 K-bps. Meanwhile, assuming that a music-playing time of is 10 seconds and the total data amount is 200 K-bits, the amount of data consumed by playing the music is 200/10=20 K-bps. Consequently, the reproducing if started at a time point to of receiving data makes the amount of consumed data in excess of the amount of data fetched to the buffer, resulting in insufficient data in the buffer and discontinuity in sound.

This problem is to be solved as follows. Namely, 50 K-bits of data A1 is stored to the buffer A in 5 seconds from a time point to of receiving data, and 50 K-bits of data B1 is stored to the buffer B in the subsequent 5 seconds. The data of totally 100 K-bits is cached for 10 seconds. Then, reproducing is started at a time point t1 that 10 seconds have passed from a data-reception time point t0. By doing this, even if the data transfer capacity after a reproduce start is smaller than the amount of data consumption, the buffers A, B are already saved with 100 k-bits of data. Also, because the remaining 100 k-bits of data (the total of C1 and A2) can be fetched to the buffers C, A for 10 seconds of from the music-play start time point t1 to the music-play end time point t2, no data exhaustion is encountered and the music can be reproduced continuously to the end.

Contrary to this, where the amount of data to be taken to the buffer exceeds the amount of consumed data, the data cache as above is not required. However, there is a need, at a time the buffer becomes a full state, of providing an instruction to the server from the data receiving section 3 not to transmit further data. In this case, when the data of the buffer is consumed to cause an empty buffer, the data receiving section 3 will acquire data from the server.

The foregoing is generalized to describe the following. Assuming that the buffer size is U and the time required in fetching data to the buffer is t, the data transfer capacity per unit time is given J=U/t. Meanwhile, the total data amount is K and the reproducing time is T, the data consumption amount E per unit time is given E=K/T. In FIG. 25, the total data amount K and the music-play time T is recorded in the header H, so that the data receiving section 3 calculates a data consumption amount E by reading the header H. Also, at a time that data A1 is fetched to the buffer A, the data transfer capacity j is calculated. As a result, if J<E, it is determined that data cache is required, thereby caching a required amount of data. In this case, if data is cached, with a data cache amount of C, to meet the condition of $$K<C+J\cdot T,$$

then it is possible to reproduce the data without discontinuity. In order to cache data, the data receiving section 3 acquires data B1 from the server and stores it in the buffer B. If the above condition is fulfilled at this time point, the data receiving section 3 forwards a ready signal to the data sorting section 4. Receiving this, the data sorting section 4 starts to sort the data to the buffers A, B. The operation from then on is as per the foregoing.

On the other hand, if J>E, data cache is not required. Consequently, the data sorting section 4 starts to sort the data at the time of receiving the data A1. However, because the buffer immediately becomes full in state after a start of reproducing, the data receiving section 3 requests the server to stop the transmission of data at a time the buffer becomes a full state. Then, if the data is consumed to cause a free space in the buffer, the data receiving section 3 again requests the server to transmit data. Namely, the data receiving section 3 intermittently acquires data from the server.

In the above manner, the data receiving section 3 monitors the data transfer capacity J. If J<E, data is cached in a required amount and thereafter reproducing is started. If J>E, data cache is not made to carry out reproducing while intermittently receiving data. This makes it possible to stably reproduce data, regardless of variation in transmission line capacity. In the case of J=E, data cache is not necessary so that data is continuously received from the server.

Herein, if the transmission line capacity is suddenly decreased due to a certain cause, the data cache to the buffer is possibly insufficient resulting in an empty state in all the buffers A, B, C. In this case, a mute signal is forwarded from the data sorting section 4 to the MIDI reproducing section 11 and audio reproducing section 12 to prohibit noise from being outputted, thereby eliminating an uncomfortable feeling to the user. Also, a front-end hold signal may be forwarded from the data sorting section 4 to the text reproducing section 13 and image reproducing section 14 thereby maintaining an on-screen display immediately before. Also, in place of these, when no data comes from the data sorting section 4 despite each reproducing section 11–14 not having received a signal representative of data end, it is also possible to adopt a method wherein a mute or front-end hold process is automatically made in each reproducing section 11–14 to resume reproducing if data comes.

In the above explanation, although the three independent buffers A, B, C were provided as the buffer 3*a*, this is merely one example and the number of buffers can be arbitrarily selected. Also, a ring buffer may be used in place of the independent buffers.

Next, explanation is made on application examples of the invention. The data reproducing apparatus of FIG. 1 or FIG. 19 can be mounted on an information terminal having a function of a telephone. As a result, a cellular phone can download a variety of information, such as sound, text and images, and reproduce them to produce sound through the speaker or display text or images on the display. For example, the CMs (commercials) or music and images, such as of karaoke, offered by the Internet can be viewed on the cellular phone. An example of such a cellular phone is shown in FIG. 37.

Figure 37:
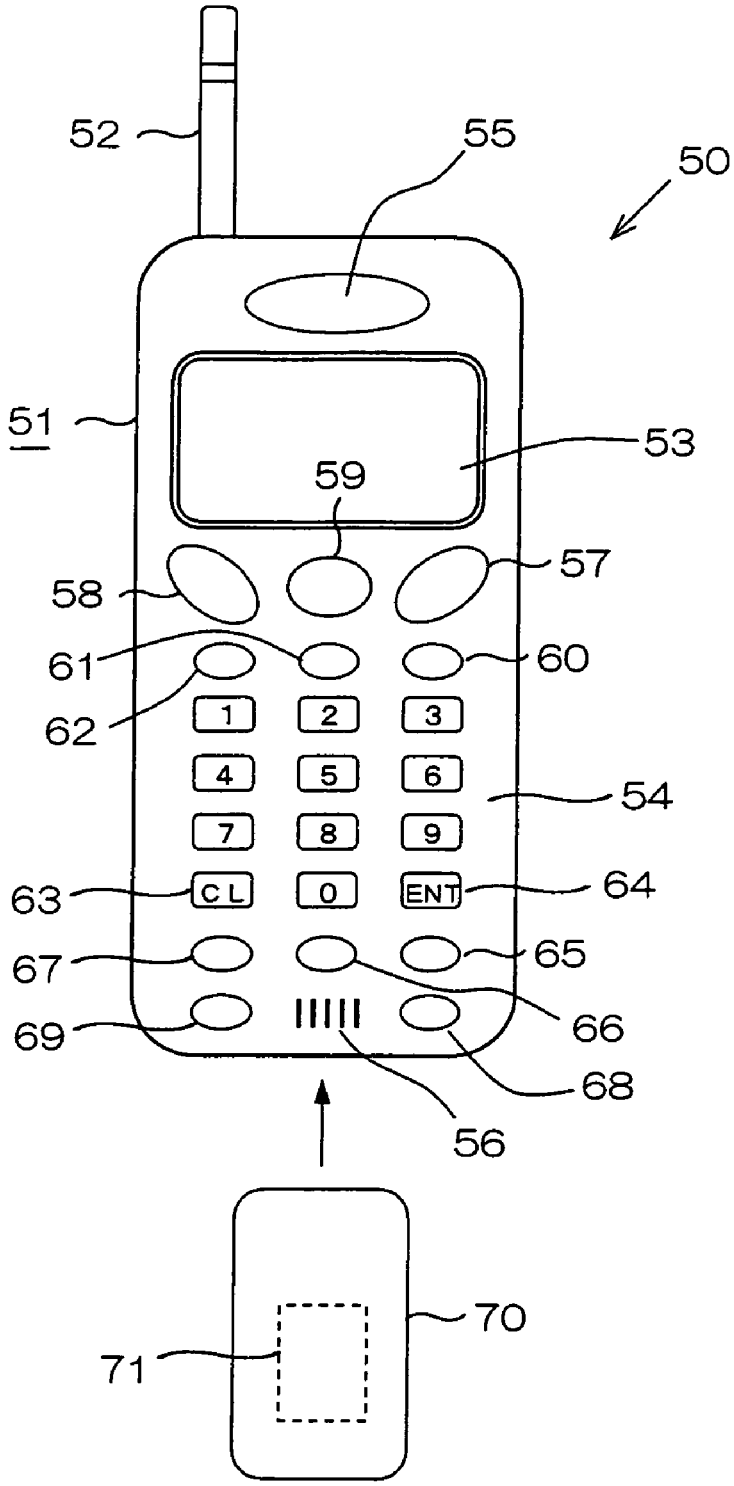
FIG. 37 is a figure showing a cellular phone mounted with the data reproducing apparatus of the invention.

In FIG. 37, 50 is a cellular phone as an information terminal and 51 is a main body of the phone, wherein the main body 51 is provided with an antenna 52, a display 53, various keys such as a numeric key 54, a speaker 55 and a microphone 56. This cellular phone 50 communicates with a base station 73, to download the data stored in a server 72 through the base station 73.

The antenna 52 transmits and receives signals to and from the base station 73. The display 53 is structured by a color liquid crystal display and the like, to display telephone numbers, images, and so on. From the speaker 55, i.e., a sound generating section, a user may hear a voice on the other end of the communication line, or a melody. The microphone 56 is used to input speech during communication or in preparing an in-absence guide message.

54 are numeric keys comprising numerals 0–9, which are used to input a telephone number or abbreviated number. 57 is a power key for turning on/off power to the phone, 58 is a talk key to be operated upon starting to talk, and 59 is a scroll key for scrolling the content displayed on the display 53. 60 is a function key for achieving various functions by the combined operation with another key, 61 is an invoking key for invoking a registered content and displaying it on the display 53, and 62 is a register key to be operated in registering abbreviated dial numbers, etc. 63 is a clear key for erasing a display content or the like, and 64 is an execute key to be operated in executing a predetermined operation. 65 is a new-piece display key for displaying a list of new pieces in downloading the music data from the server 72, 66 is an in-absence recording key to be operated in preparing an in-absence guide message, 67 is a karaoke key to be operated in playing karaoke, 68 is a music-play start key for starting a music play, 69 is a music-play end key for ending a music play.

70 is a small-sized information storage medium in the form of a card, a stick or the like which is removably attached in a slot (not shown) provided in the phone main body 51. This information storage medium 70 incorporates therein a flash memory 71 as a memory device. A variety of data downloaded is stored in this memory 71.

In the above structure, the display 53 corresponds to the display 20 of FIG. 1 or FIG. 19, to display a text or image herein. For example, in the case of CM, text, illustrations, pictures, motion pictures or the like are displayed. In the case of karaoke, titles, words, and background images are displayed. Meanwhile, the speaker 55 corresponds to the speaker 19 of FIG. 1 or FIG. 19, to output sound of MIDI or audio from here. For example, in the case of CM, CM songs or item guide messages are sounded. In the case of karaoke, accompaniment melodies or background choruses are sounded. In this manner, by mounting the data reproducing apparatus of FIG. 1 or FIG. 19 on the cellular phone 50, the cellular phone 50 can be utilized, for example, as a karaoke apparatus.

Meanwhile, MIDI data only can be downloaded from the server 72 onto the cellular phone 50. In this case, if a melody created by the MIDI is outputted as an incoming tone from the speaker 55, the incoming tone will be an especially realistic, refined music. Also, if different music of MIDI data is stored correspondingly to incoming tones to an internal memory (not shown) of the cellular phone 50 to notify the user with different melodies depending upon an incoming tone, it is possible to easily distinguish whom the call is from. Meanwhile, an incoming-call-notifying vibrator (not shown) built in the cellular phone 50 may be vibrated on the basis of MIDI data, e.g., the vibrator is vibrated in the same rhythm as a drum. Furthermore, such a use is possible so as to add BGM (BackGround Music) due to MIDI to in-absence guide messages.

Figure 38:
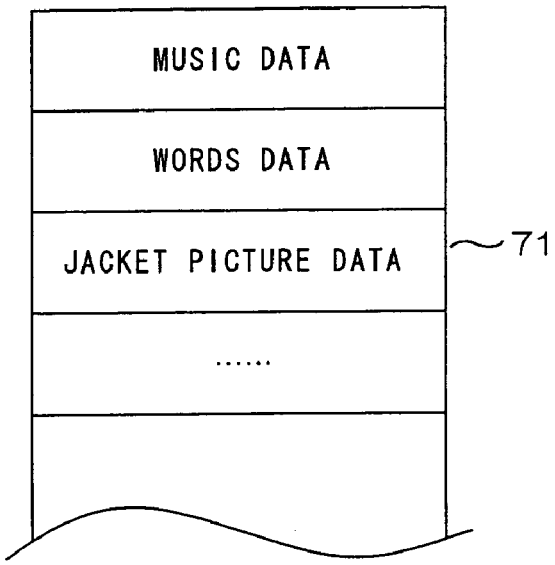
FIG. 38 is a table figure of a memory built in an information storage medium.
Figure 39:
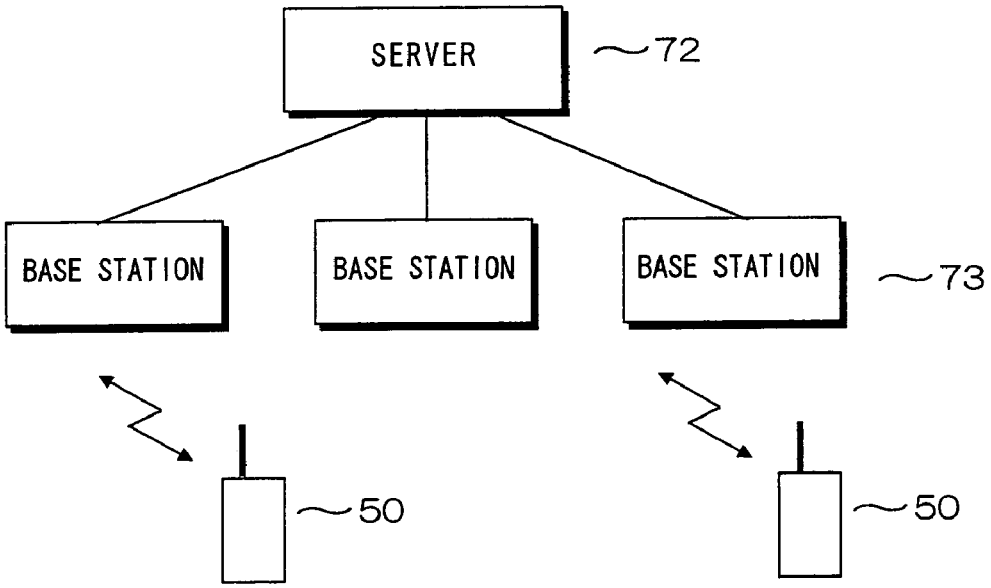
FIG. 39 is a figure showing a system using a cellular phone.

The information storage medium 70 corresponds to the external storage device 22 of FIG. 19, which can store and save music data or image data in the flash memory 71. For example, where downloading CD (Compact Disk) music data, as was shown in FIG. 38, the information storage medium 70 itself can be made as a CD by recording CD-jacket picture data due to images in addition to music data due to MIDI or audio, data of music words and commentaries and the like due to text. This is true for the case of MD (Mini Disk).

Figure 28:
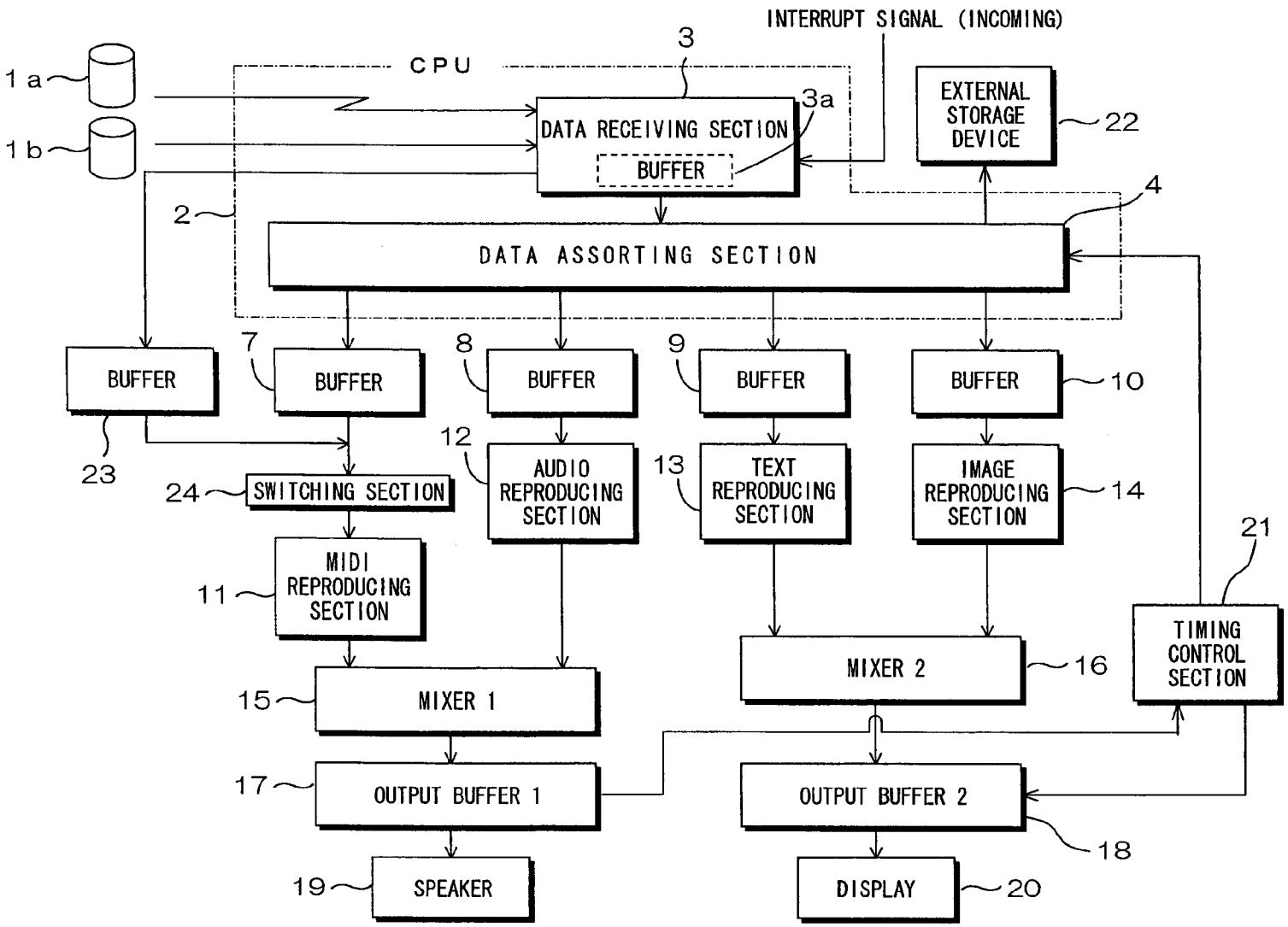
FIG. 28 is a block diagram showing another example of a data reproducing apparatus of the invention.

In the cellular phone 50 mounted with the data reproducing apparatus as above, for example where there is an incoming call during viewing CM, an incoming tone may be output. FIG. 28 shows a configuration for realizing this. The apparatus of FIG. 28 is also to be mounted on a cellular phone 50, wherein the identical parts to FIG. 19 are attached with the identical reference numerals. In FIG. 28, the difference from FIG. 19 is in that an incoming-signal buffer 23 is provided and a switch section 24 is provided between the buffer 7 and the MIDI reproducing section 11.

Figure 29:
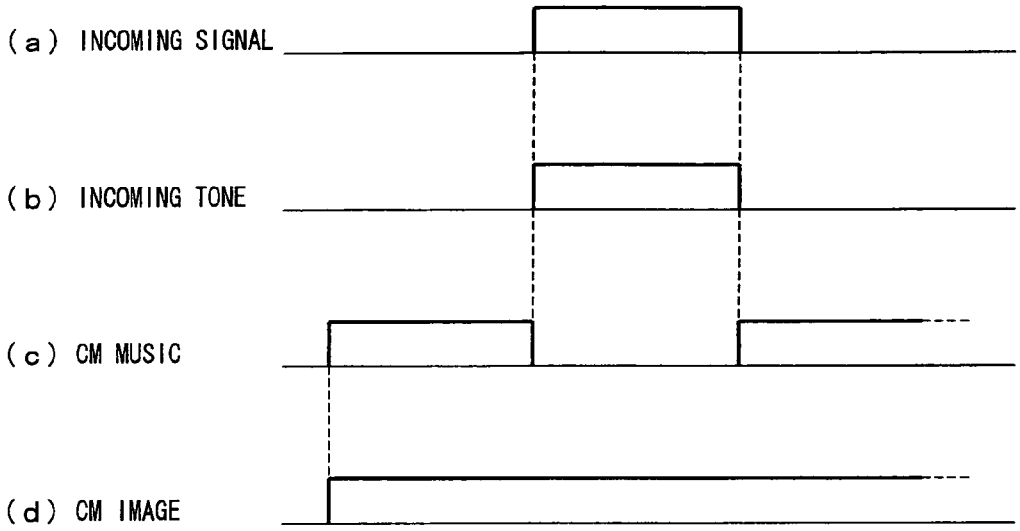
FIG. 29 is a time chart showing the operation of the apparatus of FIG. 28.

FIG. 29 is a time chart showing the operation of the data reproducing apparatus of FIG. 28. It is assumed that, first, a CM music is sounded as in (c) from the speaker 19 while a CM image is displayed as in (d) on the display 20. Now, provided that an incoming-call signal as in (a) is inputted as an interrupt signal to the data receiving section 3, the data receiving section 3 stores the data of the incoming-call signal to the buffer 23 and switches the switching section 24 from a buffer 7 to buffer 23 side. This inputs the data of the buffer 23 in place of the data of the buffer 7 to the MIDI reproducing section 11. The MIDI reproducing section 11 reads the data of the buffer 23 to create an incoming tone by the software synthesizer and outputs it to the speaker 19 through the mixer 15 and output buffer 17. As a result, a MIDI incoming tone in place of the CM music is outputted as in (b) from the speaker 19. Then, when the incoming of signal is ended to cease the incoming tone, a CM music is again sounded as in (c) from the speaker 19. The CM image is continuously displayed on the display 20 as in (d) regardless of the presence or absence of an incoming tone. In this manner, according to the data reproducing apparatus of FIG. 28, when there is an incoming signal, a incoming tone may be outputted, thus enabling the viewer to positively know the incoming signal. Also, in creating an incoming tone, because the software synthesizer of the MIDI reproducing section 11 can be commonly used, the process is simplified.

The data reproducing apparatus of the invention can be mounted, for example, on an information terminal having a function of game machine besides on an information terminal having a function of telephone. The game machine may be a game exclusive machine or an apparatus possessing both game and other functions. For example, the cellular phone 50 shown in FIG. 37 installed with the software of a game is satisfactory.

Figure 30:
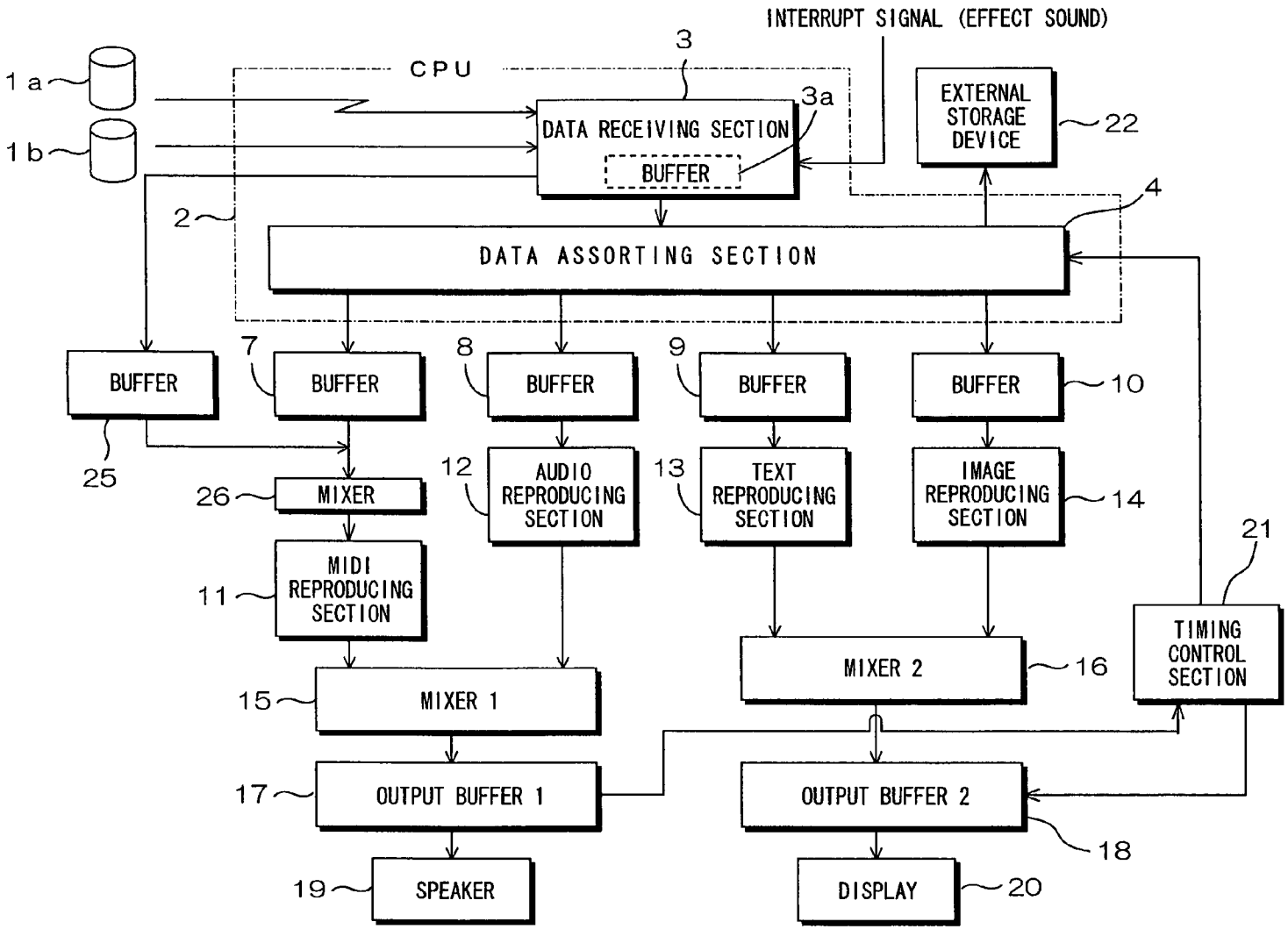
FIG. 30 is a block diagram showing another example of a data reproducing apparatus of the invention.

Although in a game machine like this music usually sounds in the background during progress of a game, an interesting game development is available if an effect sound due to MIDI is produced over a background music to the on-screen situation. FIG. 30 is a configuration for realizing this, wherein the identical parts to FIG. 9 are attached with the identical reference numerals. In FIG. 30, the difference from FIG. 19 lies in that a sound effect signal buffer 25 is provided and a mixer 26 is provided between the buffer 7 and the MIDI reproducing section 11.

Figure 31:
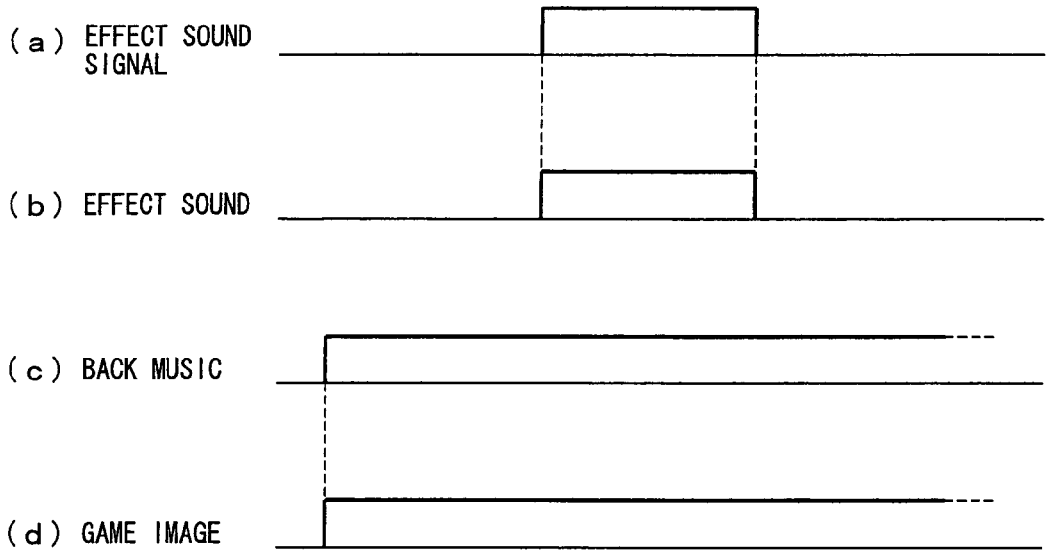
FIG. 31 is a time chart showing the operation of the apparatus of FIG. 30.

FIG. 31 is a time chart showing the operation of the apparatus of FIG. 30. It is assumed that, first, background music sounds as in (c) from the speaker 19 and a game image is displayed as in (d) on the display 20. Now, provided that a sound effect signal as in (a) is inputted as an interrupt signal to the data receiving section 3 by operating a particular button of the game machine, the data receiving section 3 stores the data of the sound effect signal to the buffer 25. The sound effect data of the buffer 25 is mixed with the data of the buffer 7, in the mixer 26. The MIDI reproducing section 11 reads the data of the mixer 26, creates a sound effect in addition to the background music by the software synthesizer, and outputs these onto the speaker 19 through the mixer 15 and output buffer 17. As a result, a sound effect due to MIDI (e.g., explosion sound) as in (b) is outputted from the speaker 19. During ringing of this sound effect, the background music continuously sounds as in (c). Then, if the sound effect signal ends, the sound effect from the speaker 19 ceases, resulting in sounding of the background music only. The game image is continuously displayed on the display 20 as in (d). In this manner, according to the data reproducing apparatus of FIG. 30, a game machine can be realized which is capable of ringing a sound effect due to MIDI over background music. Also, because the software synthesizer of the MIDI reproducing section 11 can be commonly used in creating a sound effect, the process is simplified.

Figure 32:
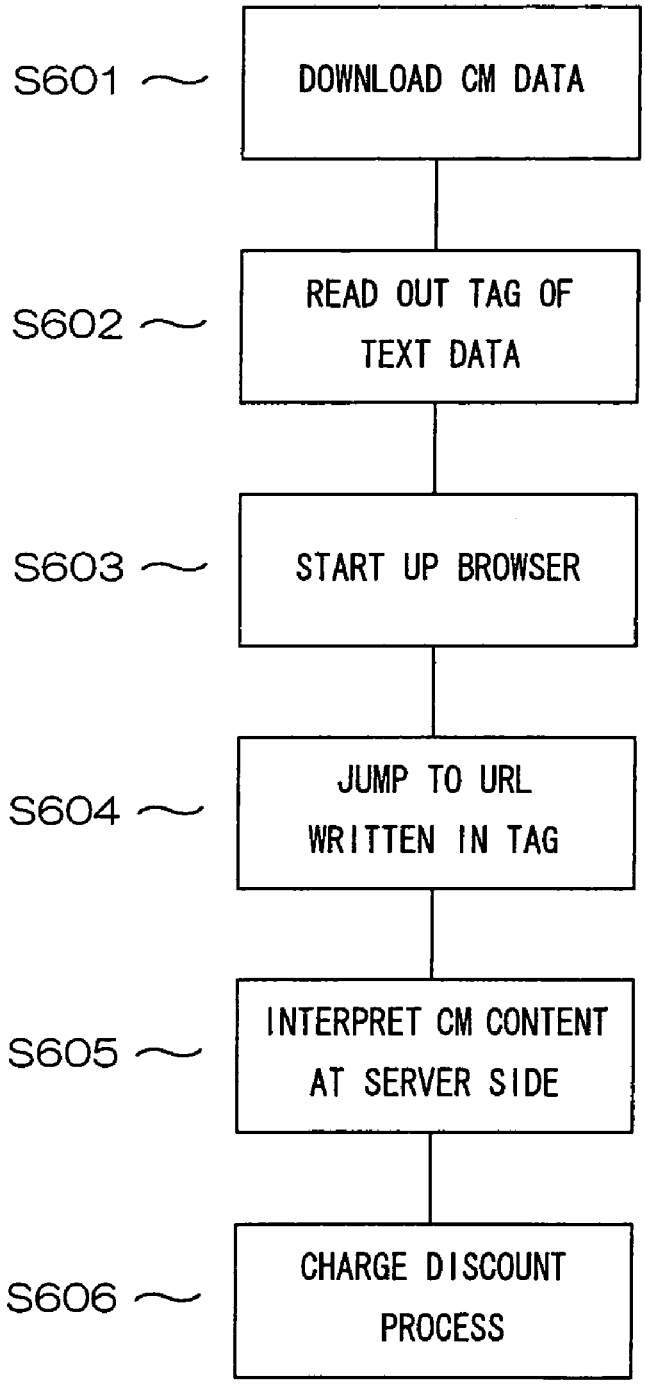
FIG. 32 is a flowchart in the case of implementing a charge discount process using the data reproducing apparatus of the invention.
Figure 33:
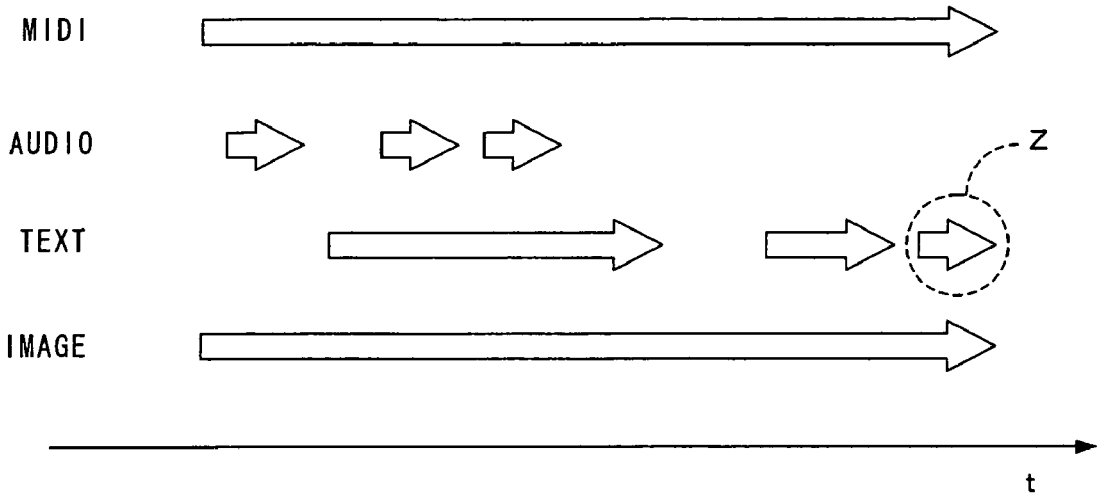
FIG. 33 is a figure chronologically showing each of data configuring CM.
Figure 34:
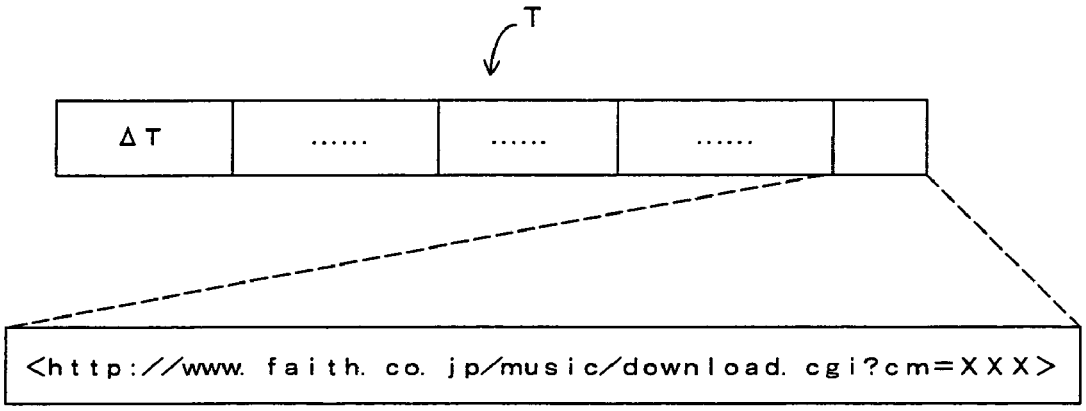
FIG. 34 is an example of a tag to be added to text data.

The use of the data reproducing apparatus of the invention can realize a system having various functions besides the above. FIG. 32 to FIG. 34 are examples of the same, where a given benefit is provided to the people who have viewed a particular CM on the Internet. Each of MIDI data, audio data, text data and image data is mixed in CM information in a chronological fashion, as in FIG. 33. Consequently, a tag describing URL (Uniform Resource Locator) as shown in FIG. 34 is inserted in the last part of text data (broken lines Z). In the tag, "XXX" in the last part is information representative of what CM it is.

As can be seen in the flowchart of FIG. 32, the viewer first downloads CM data from a file 1*a* (see FIG. 1, FIG. 19) in a server on the Internet (S601). This CM data is received by the data receiving section 3, sorted to each section by the data sorting section 4, and reproduced by the foregoing procedure and outputted from the speaker 19 and display 20. Herein, if the text data received is reproduced last by the text reproducing section 13, a tag shown in 34 is read out (S602).

Subsequently, a browser (perusal software) is started up (S603), and a jump is made to a homepage of a URL described in the read-out tag (S604). The server of the URL jumped to (not shown) interprets the "XXX" part of the tag to determine as to what CM has been viewed (S605), and in case that a product of the CM is purchased over the network to carry out a process, for example, of charge at a rate discounted by 20% (S606). Thus, according to the above system, discount service can be offered to the persons who have viewed the CM.

Figure 35:
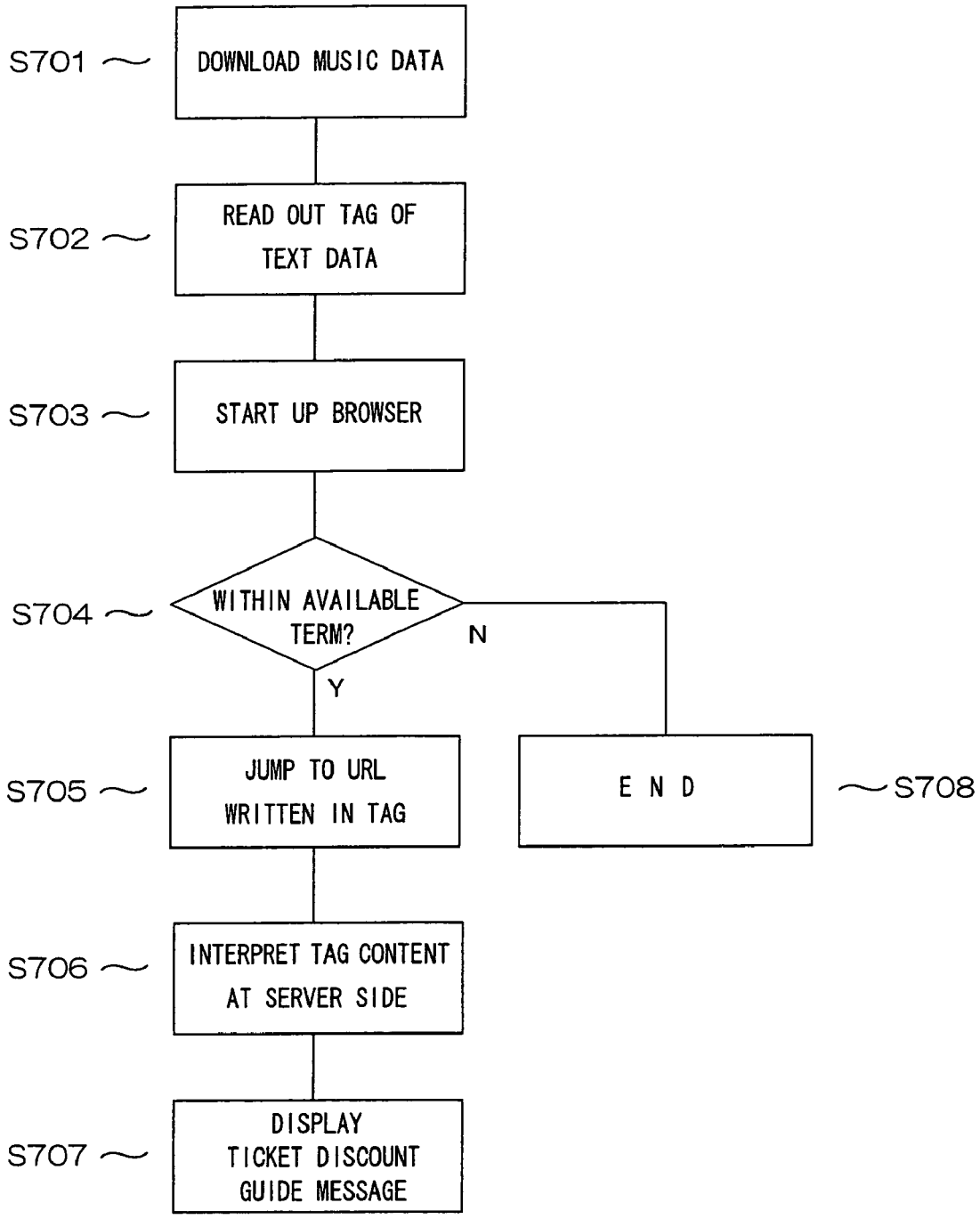
FIG. 35 is a flowchart in the case of implementing the service with an available period using the data reproducing apparatus of the invention.
Figure 36:
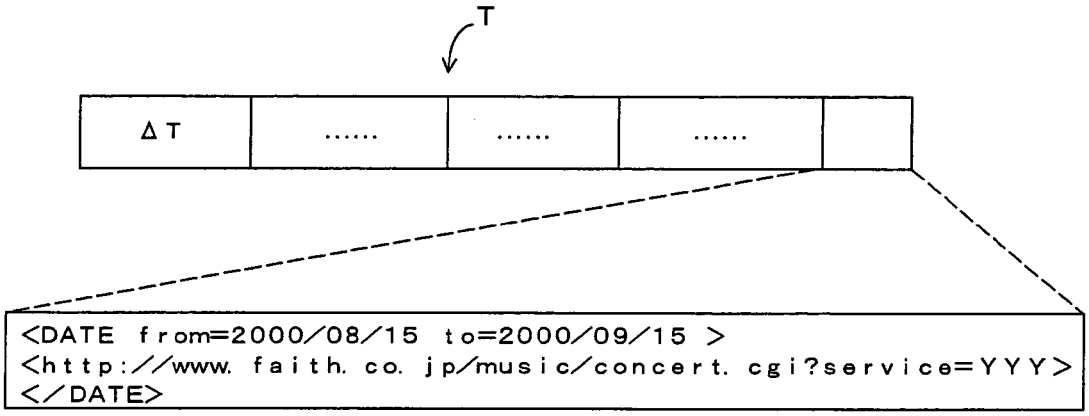
FIG. 36 is an example of a tag to be added to text data.

FIG. 35 and FIG. 36 is another application example using the data reproducing apparatus of the invention, showing an example of providing ticket discount services to a person who has purchased music data over the Internet. In this case, the music data is added to with words, music commentary, introduction of players or the like as text data, wherein a tag as shown in FIG. 36 is inserted in the last part of the text data. In the tag, "from =2000/08/15 to =2000/09/15" represents that the ticket available term is from Aug. 15, 2000 to Sep. 15, 2000. Meanwhile, "YYY" in the last is the information representative of what the purchased music data is.

As can be seen in the flowchart of FIG. 35, the viewer first downloads music data from a file 1*a* in a server on the Internet (S701). The music data is received by the data receiving section 3 and sorted by the data sorting section 4 to each section, followed by being reproduced in the foregoing procedure and outputted from the speaker 19 and display 20. Also, each type of data is stored to and saved in the external storage device 22 (in FIG. 37, information storage medium 70). Herein, if the received text data is reproduced last in the text reproducing section 13, the tag shown in FIG. 36 is read out (S702).

Subsequently, a browser is started up (S703), to determine whether the current date is within the available term or not (S704). This determination is made by making reference to the available term described in the foregoing tag. If the current date is within the available term (S704 YES), a jump is made to a homepage of the URL described in the read-out tag (S705). If the current date is not within the available term (S704 NO), nothing is done and processing ends (S708).

The server of the URL jumped to (not shown) interprets the "YYY" part of the tag to determine what music data has been purchased (S706), and transmits a guide message that a ticket of a concert by the musical artist is to be purchased at a discount price, thus displaying the message on the display 20 (S707). Therefore, according to the above system, it is possible to induce the person who has purchased music data to purchase a ticket.

INDUSTRIAL APPLICABILITY

The data reproducing apparatus of the present invention can be mounted on an information terminal in various kinds, such as a personal computer and an Internet-TV STB (Set Top Box) besides the foregoing cellular phone or game machine.

What is claimed is:

1. A data reproducing apparatus for receiving and reproducing data including event information and time information for executing an event, the data reproducing apparatus comprising:

a data receiving section capable of receiving a plurality of types of data having event information different in attribute;

a data sorting section for, while referring to time information of each of the plurality of types of data received by said data receiving section, sorting the plurality of types of data based on data type and the time it takes to execute an event of each of the plurality of types of data;

a data reproducing section for executing an event recorded in each of the plurality of types of data sorted by said data sorting section thereby reproducing the relevant data; and an output section for outputting data reproduced by said data reproducing section.

2. A data reproducing apparatus according to claim 1, wherein the plurality of types of data comprise first data having MIDI event information and second data having event information of other than MIDI.

3. A data reproducing apparatus according to claim 2, wherein the second data includes data having text event information and data having image event information.

4. A data reproducing apparatus according to claim 3, wherein the second data further includes data having audio event information.

5. A data reproducing apparatus according to claim 3, wherein commercial information including text is to be received, the text data including an URL to be jumped to upon starting up a browser of the Internet and information for offering service to a homepage viewer of the URL.

6. A data reproducing apparatus for receiving and reproducing data including event information and time information for executing an event, the data reproducing apparatus comprising:

a data receiving section capable of receiving data having MIDI event information, data having text event information and data having image event information;

a data sorting section for, while referring to time information of each of the plurality of types of data received by said data receiving section, sorting the plurality of types of data based on data type and the time it takes to execute an event of each of the plurality of types of data;

a data reproducing section for executing an event recorded in data sorted by said data sorting section thereby reproducing the relevant data;

a first output section for outputting, as a sound, MIDI data reproduced by said data reproducing section; and a second output section for outputting, as visible information, text and image data reproduced in said data reproducing section.

7. A data reproducing apparatus according to claim 6, wherein said data receiving section is further capable of receiving data having audio event information, said first output section outputting, as a sound, MIDI and audio data reproduced by said data reproducing section.

8. A data reproducing apparatus according to claim 7, having:

a first mixer for mixing MIDI and audio data reproduced by said data reproducing section, and a second mixer for mixing text and image data reproduced by said data reproducing section, wherein:

said first output section outputs data mixed by said first mixer, said second output section outputting data mixed by said second mixer.

9. A data reproducing method for receiving and reproducing data including event information and time information for executing an event, the data reproducing method comprising:

receiving first data having MIDI event information and second data having event information of other than MIDI;

referring to time information of each of the plurality of types of received data and sorting each of the plurality of types of data based on data type and the time it takes to execute an event of each of the plurality of types of data;

reproducing sorted data due to execution of events recorded therein; and outputting respective ones of reproduced data.

10. A data reproducing apparatus for receiving and reproducing data including event information and time information for executing an event, the data reproducing apparatus comprising:

a data receiving section capable of receiving a plurality of types of data having event information different in attribute;

a data sorting section for, while sequentially referring to time information of each of the plurality of types of data received by said data receiving section to determine data to be processed within a unit section having a predetermined time duration and sorting, for each unit section, the relevant data based data type;

a storage section for temporarily storing data sorted by said data sorting section based on data type;

a data reproducing section provided correspondingly to kinds of data and for sequentially reading out, in a next unit section, data at each unit section stored in said storage section and executing an event recorded in each of data thereby reproducing the data; and an output section for outputting respective ones of data reproduced by said data reproducing section.

11. A data reproducing apparatus according to claim 10, wherein said data sorting section sorts, for storage to said storage section, the data to be processed based on data type in a last timing of a unit section, said data reproducing section sequentially reading out, in a next unit section, data at the unit section sorted by said data sorting section to execute an event of the relevant data.

12. A data reproducing apparatus according to claim 11, wherein the time information is a delta time defined as a time of from an execution time point of a last-time event to an execution of an event in this time, said data sorting section calculating a time duration of a process section that this-time data is to be processed from a difference between a time at present as a time at the last in a unit section and an execution time of a last event in a unit section precedent by one, and sorting and storing, into storage section, unit-section data such that a sum of a delta time of each event in the relevant process section is fallen within a range of the time duration, said data reproducing section reproducing unit-section data sorted by said data sorting section in a next unit section having a same time duration as the relevant unit section.

13. A data reproducing apparatus according to any of claims 10 to 12, wherein provided is a timing control section for controlling timings at a start and end of the unit section.

14. A data reproducing apparatus according to claim 13, wherein said output section has a function to count the number of output data to forward a control signal to said timing control section depending upon a count value thereof, said timing control section outputting a timing signal depending upon the control signal.

15. A data reproducing method for receiving and reproducing data including event information and time information for executing an event, the data reproducing method comprising:

receiving a plurality of kinds of data having event information different in attribute;

referring to time information of each of received data to determine data to be processed within a unit section having a predetermined time duration, and sorting, for each unit section, the relevant data based on data type for temporary storage to a storage section;

sequentially reading out, in a next unit section, data at each unit section stored in said storage section and executing an event recorded in the relevant data thereby reproducing the data; and outputting respective ones of reproduced data.

16. A data reproducing apparatus for reproducing, while downloading, stream data according to claim 1 or 10, wherein:

said data receiving section has a buffer, said data receiving section calculating a data transfer capacity J per unit time and a data consumption amount E per unit time on the basis of data first received, where $J<E$, reproducing is started after caching an required amount of data to said buffer, while where $J>E$, reproducing being made while intermittently receiving data without carrying out caching.

17. A information terminal mounted with a data reproducing apparatus according to claim 1 or 10, wherein various types of data are to be downloaded, the information terminal including a sound generating section for outputting sound on the basis of downloaded data and a display for displaying a text and image on the basis of the downloaded data.

18. An information terminal according to claim 17, wherein a small-sized information storage medium is to be attached and detached, to store downloaded MIDI music data, text words data and image jacket data to said information storage medium.

19. An information terminal according to claim 17, wherein:

having a cellular-phone function of outputting speech voice from said sound generating section and displaying a telephone number on said display, and an accompaniment music being outputted from said sound generating section and displaying words and a background image being displayed on said display depending on downloaded data thereby making possible to utilization as a karaoke apparatus.

* * * * *